US011629444B2

(12) United States Patent
Zhang et al.

(10) Patent No.: US 11,629,444 B2
(45) Date of Patent: Apr. 18, 2023

(54) FRAME OF CLOTHING TREATING DEVICE, AND CLOTHING TREATING DEVICE

(71) Applicants: QINGDAO HAIER LAUNDRY ELECTRIC APPLIANCES CO., LTD., Shandong (CN); HAIER SMART HOME CO., LTD., Shandong (CN)

(72) Inventors: Xinhua Zhang, Shandong (CN); Wenwei Li, Shandong (CN); Benfu Xing, Shandong (CN); Shaolei Yi, Shandong (CN); Zhiwei Zhao, Shandong (CN)

(73) Assignees: QINGDAO HAIER LAUNDRY ELECTRIC APPLIANCES CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 156 days.

(21) Appl. No.: 16/966,532

(22) PCT Filed: Jan. 31, 2019

(86) PCT No.: PCT/CN2019/074154

§ 371 (c)(1),
(2) Date: Jul. 31, 2020

(87) PCT Pub. No.: WO2019/149246

PCT Pub. Date: Aug. 8, 2019

(65) Prior Publication Data

US 2021/0047769 A1 Feb. 18, 2021

(30) Foreign Application Priority Data

Feb. 1, 2018 (CN) ..... 201810103208.4
Feb. 1, 2018 (CN) ..... 201810103574.X
Feb. 13, 2018 (CN) ..... 201810148815.2

(51) Int. Cl.
*D06F 29/00* (2006.01)
*D06F 31/00* (2006.01)
*D06F 39/12* (2006.01)

(52) U.S. Cl.
CPC ..... *D06F 29/005* (2013.01); *D06F 31/00* (2013.01); *D06F 39/12* (2013.01)

(58) Field of Classification Search
CPC ..... D06F 39/12; D06F 31/00; D06F 29/00; D06F 29/005
(Continued)

(56) References Cited

U.S. PATENT DOCUMENTS 2,833,137 A * 5/1958 Peter ..... D06F 58/02 68/19.2
2,871,688 A * 2/1959 Peter ..... D06F 29/005 68/19.2
(Continued)

FOREIGN PATENT DOCUMENTS

CN 101440562 A 5/2009
CN 201538907 U 8/2010
(Continued)

OTHER PUBLICATIONS

Hu et al., "Combined washing and drying machine" Jul. 2012, CN102605586A—machine translation (Year: 2012).*
(Continued)

*Primary Examiner* — David G Cormier
*Assistant Examiner* — Thomas Bucci
(74) *Attorney, Agent, or Firm* — Buchanan Ingersoll & Rooney PC

(57) ABSTRACT

A clothing treating device comprises first and second clothing treating drums which are arranged in longitudinal order.
(Continued)

A frame comprises a lower frame configured to place the second clothing treating drum. An upper frame is mounted on a top of the lower frame, and is configured to mount the first clothing treating drum. By setting the upper frame and lower frame independent from each other, an objective of replacing and repairing parts of the frame may be achieved. The first clothing treating drum and the second clothing treating drum are respectively mounted in corresponding parts of the frame in order to realize a modular management of the device, and a device with only the second clothing treating drum and a device with both the first and second clothing treating drums may be produced on the same production line, thereby improving modularity of the device and reducing production cost.

19 Claims, 15 Drawing Sheets

(58) Field of Classification Search
USPC ..... 68/3 R, 13 R; 312/198
See application file for complete search history.

(56) References Cited

U.S. PATENT DOCUMENTS 3,545,235 A * 12/1970 Menk ..... D06F 58/02 68/19.2
3,824,813 A * 7/1974 Davis ..... D06F 34/10 68/19.2
4,454,732 A * 6/1984 Burkland ..... D06F 39/12 248/676
4,507,942 A * 4/1985 Hirose ..... D06F 29/005 312/236
4,531,387 A * 7/1985 Cotton ..... D06F 39/14 312/139.2
D288,737 S * 3/1987 Deatherage ..... D32/5
4,680,948 A * 7/1987 Rummel ..... D06F 29/00 68/3 R
4,821,535 A * 4/1989 Wassilak ..... D06F 29/005 211/186
4,972,687 A * 11/1990 Czech ..... D06F 29/00 68/3 R
4,989,426 A * 2/1991 Kretchman ..... D06F 29/00 248/676
5,653,416 A * 8/1997 Frank ..... F16M 11/16 312/107
5,926,886 A * 7/1999 Braunschweig ..... D06F 39/12 68/3 R
5,951,130 A * 9/1999 Braunschweig ..... D06F 29/00 312/257.1
8,176,755 B2 * 5/2012 Lim ..... D06F 58/26 68/3 R
8,341,981 B2 * 1/2013 Kim ..... D06F 39/125 68/3 R
D854,764 S * 7/2019 Park ..... D32/25
2005/0139738 A1 * 6/2005 Hwang ..... D06F 39/125 248/300
2006/0010934 A1 * 1/2006 Kim ..... D06F 39/12 68/3 R
2009/0007602 A1 * 1/2009 Woo ..... D06F 39/10 68/208
2009/0145176 A1 * 6/2009 Kim ..... D06F 39/12 29/700
2009/0145177 A1 * 6/2009 Kim ..... D06F 39/125 68/13 R
2010/0083710 A1 * 4/2010 Han ..... D06F 31/00 68/13 R
2010/0083711 A1 * 4/2010 Han ..... D06F 29/005 68/13 R
2010/0101282 A1 * 4/2010 Jeong ..... D06F 37/145 68/139
2010/0192639 A1 * 8/2010 Kim ..... D06F 58/20 68/20
2011/0030428 A1 * 2/2011 Han ..... D06F 29/00 68/5 R
2011/0041560 A1 * 2/2011 Lee ..... D06F 39/125 68/9
2016/0010719 A1 * 1/2016 Kim ..... F16F 15/08 248/673
2016/0160420 A1 * 6/2016 Lv ..... D06F 31/00 68/27
2017/0342649 A1 * 11/2017 You ..... F25B 30/02
2018/0187361 A1 * 7/2018 Son ..... D06F 31/00
2018/0187367 A1 * 7/2018 Bae ..... B01D 53/261

FOREIGN PATENT DOCUMENTS

CN 102605586 A * 7/2012 ..... D06F 29/00
CN 102605586 A 7/2012
CN 202519474 U 11/2012
CN 203741597 U 7/2014
CN 105019185 A 11/2015
CN 208038876 U 11/2018
CN 208038877 U 11/2018
CN 208151675 U 11/2018
CN 208151676 U 11/2018
CN 208151701 U 11/2018
CN 208151702 U 11/2018
CN 208151703 U 11/2018
CN 208151704 U 11/2018
CN 208151705 U 11/2018
CN 208151706 U 11/2018
JP H07251000 A 10/1995
WO 2004097098 A1 11/2004

OTHER PUBLICATIONS

International Search Report (with English Translation) and Written Opinion issued in corresponding International Patent Application No. PCT/CN2019/074154, 11 pages (dated Apr. 16, 2019).
Office Action (Request for the Submission of an Opinion) dated Aug. 1, 2022, in corresponding Korean Patent Application No. 10-2020-7025113 and English translation of the Office Action. (10 pages).

* cited by examiner

FRAME OF CLOTHING TREATING DEVICE, AND CLOTHING TREATING DEVICE

TECHNICAL FIELD

The present disclosure relates to the technical field of washing machines, and in particular relates to a frame of a washing machine with two clothing treating drums, and also relates to a clothing treating device using the frame.

BACKGROUND

Washing machines being as a household appliance have been widely used in people's lives. There are a variety of cases of washing machines, some of cases have an integral structure, and some of cases have a structure assembled by plural sheets. However, the cases of the washing machines having an integral structure have disadvantages of a high processing cost and a high requirement for properties of materials, and the cases of the washing machines having a structure assembled by plural sheets have disadvantages of difficulty in moulding and not high strength due to a connection manner.

Cases of washing machines are formed by covering an outer portion of a support frame having a certain strength with a cover plate of an upper case. In the existing washing machines, generally a plurality of support rods form cuboid edges to form a cuboid, and then contact points of the support rods are fixed to form a frame of a washing machine.

For example, in a Chinese patent with the patent number of 200920241062.6, a case of a washing machine is disclosed, which comprises a front panel, a rear panel, a left side plate and a right side plate, wherein an upper frame consisting of an upper left edge beam, an upper front beam and an upper right edge beam is fixedly connected with a top of the rear panel, a lower frame consisting of a lower left edge beam, a lower front beam and a lower right edge beam is fixedly connected with a bottom of the rear panel, the left side plate is fixedly mounted between the upper left edge beam and the lower left edge beam, the front panel is fixedly mounted between the upper front beam and the lower front beam, and the right side plate is fixedly mounted between the upper right edge beam and the lower right edge beam.

However, when the existing frame is applied to a double-drum washing machine, the support strength provided is insufficient, and it is impossible to provide a sufficient mounting support strength for upper and lower drums.

In view of the above, the present disclosure is set forth.

SUMMARY

An objective of the present disclosure is to provide a frame of a clothing treating device, so as to effectively support two clothing treating drums placed longitudinally and improve the support strength of the entire machine.

To achieve the objective of the present disclosure, technical solutions adopted are as follows.

A frame of a clothing treating device is disclosed. The clothing treating device comprises a first clothing treating drum and a second clothing treating drum which are arranged in longitudinal order. The frame comprises a lower frame configured to place the second clothing treating drum, an upper frame extending upwards is mounted on a top of the lower frame and configured to place the first clothing treating drum.

Further, the lower frame comprises a base placed horizontally, and the base is square. Four corners of the base are provided with vertical beams extending vertically upwards, and at least one pair of adjacent vertical beams is fixed via a middle reinforcing member to enclose a frame structure for mounting the second clothing treating drum. Preferably, adjacent vertical beams on a left side are fixedly connected respectively via a left middle reinforcing member, and adjacent vertical beams on a right side are fixedly connected respectively via a right middle reinforcing member. Further preferably, the left middle reinforcing member and the right middle reinforcing member are arranged symmetrically.

Further, the upper frame comprises two upper vertical beams extending vertically upwards arranged at a left end and a right end near a front side of the frame. Lower ends of the two upper vertical beams are both fixedly connected with the lower frame, and tops of the two upper vertical beams are respectively connected with upper reinforcing members extending rearwards of the frame.

Further, the lower ends of the upper vertical beams of the upper frame are fixedly connected with the middle reinforcing members of the lower frame and/or upper ends of the vertical beams.

Further, the lower ends of the upper vertical beams are correspondingly attached to and in contact with the middle reinforcing members and/or the upper ends of the vertical beams and are fixedly connected therewith by screws. Preferably, outer sides of the lower ends of the upper vertical beams and inner sides of the middle reinforcing members are attached correspondingly. The upper vertical beams are fixedly connected with the middle reinforcing members by longitudinally connecting two screws at attaching and contacting positions.

Further, the top ends of the upper vertical beams are provided with flanges bent horizontally rearwards, end portions of the upper reinforcing members are correspondingly lapped on upper sides of the flanges in an attaching manner and fixedly connected therewith by screws. Preferably, each of the upper vertical beams with L-shaped cross sections is composed of a front side plate and a lateral side plate in strip shape, the front side plate is parallel to or overlapped with a front side of the frame, and the lateral side plate is parallel to or overlapped with a lateral portion of the frame. An upper end of the lateral side plate is provided with a notch extending horizontally, an upper end of the front side plate is provided with a fold line extending horizontally. The fold line is set to be aligned with the notch so that the flanges are formed by bent portions, formed by rearwards bending upper ends of the upper vertical beams by 90° around the fold lines, of the upper vertical beams.

Further, the flange includes a horizontal flange horizontally bent rearwards by a top end of the front side plate of the upper vertical beam and a vertical flange vertically bent downwards by a lateral portion of the horizontal flange. The vertical flange and the lateral side plate of the upper vertical beam are correspondingly attached and riveted to be fixed. The end portion of the upper reinforcing member is lapped on an upper side of the horizontal flange and connected therewith by a screw. Preferably, a rearward extending length of the horizontal flange is greater than a horizontal width of the lateral side plate of the upper vertical beam, so that the end portion of the horizontal flange protrude from the upper vertical beam and is provided for lapping and attaching with the upper reinforcing member.

Further, the upper reinforcing members have strip-shaped structures with L-shaped cross sections. And inner walls of two sides of the upper reinforcing members are respectively in contact with the upper sides of the horizontal flanges and outer sides of the vertical flanges in a limiting manner.

Further, a rear side of the lower frame is further provided with a middle rear reinforcing member, the middle rear reinforcing member extends horizontally. Two ends of the middle rear reinforcing member are respectively fixedly connected with upper portions of the two vertical beams at a rear side. Preferably, rear ends of two upper reinforcing members are respectively configured to connect with a rear fixing plate of the first clothing treating drum. The lower frame is configured to fixedly connect with a lower end of the rear fixing plate.

The present disclosure further introduces a clothing treating device. The clothing treating device is comprises the first clothing treating drum and the second clothing treating drum for treating clothing, and any of the above frames is mounted in the clothing treating device.

Preferably, a clothing treating device comprises a heat pump system, a frame and a mounting platform mounted on the frame. The heat pump system comprises a compressor mounted on the mounting platform and a cooling fan. The cooling fan is fixed on the frame and arranged corresponding to the compressor.

In the above solution, in consideration of the problem of a small internal space of the mounting platform, the cooling fan is fixed on the frame. So that a mounting space on the mounting platform is saved, and besides, the cooling fan is closer to a case of the clothing treating device, thereby improving ventilation effects and helping to cool the compressor.

Preferably, the frame comprises a lateral frame for fixing a side plate of the clothing treating device, and the cooling fan is fixed on the lateral frame.

In the above solution, the cooling fan is mounted on the respective lateral frame of the frame, and then a vent is formed in the side plate of the case of the clothing treating device without a need of forming a vent in a front panel of the clothing treating device. So that an integral structure of the front panel of the entire machine is maintained, thereby making the front panel integral, benefiting aesthetics of the front panel and playing a significant role in improving aesthetics of the clothing treating device.

Preferably, the lateral frame comprises two vertical beams vertically arranged. A reinforcing member is connected between the two vertical beams. The cooling fan is fixed on the reinforcing member and/or one of the two vertical beams.

In the above solution, lateral frames are respectively arranged on two sides of the frame, and each of the lateral frames is provided with two vertical beams and reinforcing members connecting the two vertical beams, and the cooling fan is fixed on the reinforcing member on one side of the frame.

Preferably, one side of the mounting platform close to the reinforcing members is provided with a mounting portion, the compressor is fixed on the mounting portion. The cooling fan is fixed on the reinforcing member and/or the vertical beams and arranged corresponding to the compressor.

In the above solution, the mounting portion is arranged on one side of the mounting platform positioned at the reinforcing members, so that the compressor is mounted on an edge position of the mounting platform, thereby being not only beneficial for cooling the cooling fan but also suitable for the structure of the mounting platform.

Preferably, the cooling fan is arranged on the reinforcing member facing to the compressor. Or the cooling fan is arranged on the reinforcing member in staggered arrangement with the compressor, and a suction surface of the cooling fan is arranged facing to the compressor.

Preferably, a first clothing treating drum and a second clothing treating drum are mounted longitudinally in the frame. The mounting platform is fixed between the first clothing treating drum and the second clothing treating drum in the frame. A middle portion of the mounting platform is protruded to form a collision avoiding portion for avoiding collision with the second clothing treating drum. One side, on the mounting platform, of the collision avoiding portion is in a planar arrangement to form a mounting portion. The compressor is mounted on the mounting portion, and the cooling fan is fixed on the reinforcing member and/or the vertical beams, close to the one side of the mounting portion, of the frame.

In the above solution, the reinforcing members are further connected with spring assemblies of the second clothing treating drum in a hooking manner, and the two reinforcing members on two sides of the frame hook the two spring assemblies on two sides of the second clothing treating drum respectively.

Preferably, the cooling fan is fixed on the frame via a fixing frame. The fixing frame comprises a fixing portion for mounting the cooling fan and a connecting portion for connecting and fixing to the reinforcing members and/or vertical beams. The fixing portion is inclined towards the compressor so that the suction surface of the cooling fan is arranged facing to the compressor.

In the above solution, when the cooling fan and the compressor are mounted in a staggered manner, the fixing portion on the fixing frame is inclined towards the compressor, so that after the compressor is mounted at the fixing portion, the suction surface of the cooling fan is arranged directly facing to the compressor.

Preferably, the connecting portion of the fixing frame is positioned on two sides of the fixing portion. The connecting portion at one side of the fixing portion is fixed to the reinforcing member, and the connecting portion at the other side of the fixing portion is fixed to one vertical beam arranged in front of the frame and connected with the reinforcing member.

In the above solution, in order to achieve a stable fixation of the cooling fan, the fixing frame and the compressor are mounted in a staggered manner, and are respectively connected to the vertical beam at the front portion of the frame and the reinforcing member connected to the vertical beam via the connecting portion. Such a structure may achieve an effect of stably fixing the cooling fan.

Preferably, the fixing frame has a sheet-like structure, and a partial surface of the sheet-like structure is inclined towards the compressor and protrudes to form the fixing portion for fixing the cooling fan, and a portion of the frame positioned on an edge of the fixing portion is the connecting portion.

The connecting portion of the fixing frame has a sheet-like structure, and is attached and fixed to the lateral frame on one side of the frame and is parallel to a surface of the lateral frame. The fixing portion also has a sheet-like structure, a surface of the sheet-like structure is inclined towards the compressor so that the surface of the fixing portion and the surface of the connecting portion are set to form a certain included angle, and the fan, after being mounted on the fixing portion, forms an included angle of 3° with the lateral frame of the frame.

Preferably, a surface of the fixing portion having a sheet-like structure is provided with a notch matched with the cooling fan in shape, and the cooling fan is mounted and fixed at the notch. Preferably, a contour surface of the fixing portion has an L-shaped structure, and the cooling fan has a square plate-like structure. Two adjacent sides of the square plate-like structure are respectively fixed to two inner walls of the L-shaped structure via fasteners.

Preferably, an edge of the surface of the fixing portion positioned at the notch is provided with connecting holes so as to be fixed to the cooling fan via fasteners.

Further, the fixing portion having an L-shaped structure comprises a vertical plane extending along a vertical direction and a horizontal plane extending along a horizontal direction. The connecting portion comprises a first connecting plane and a second connecting plane which are connected with the vertical plane and the horizontal plane respectively. The first connecting plane is fixed to the vertical beam on one side in the front portion of the frame, and the second connecting plane is fixed to the reinforcing member connected with the vertical beam. The cooling fan is mounted on a surface of the fixing portion protruding from a portion between the first connecting plane and the second connecting plane.

Preferably, the mounting platform comprises a collision avoiding portion partially protruding and a mounting portion in a planar arrangement. The heat pump system comprises a compressor fixed on the mounting portion of the mounting platform.

In the above solution, the mounting platform is provided with the collision avoiding portion protruded corresponding to the second clothing treating drum at the bottom of the mounting platform. The design of the collision avoiding portion is not beneficial for mounting and fixing the compressor. Therefore, in the present disclosure, the mounting structure of the compressor is improved adaptively according to a completely new structure of the mounting platform, which not only ensures fixing stability of the compressor but also saves a mounting space of the mounting platform.

Preferably, the first clothing treating drum and the second clothing treating drum are mounted longitudinally in the frame. The collision avoiding portion is of an arched structure of a surface of the mounting platform protruding upwards corresponding to a top of the second clothing treating drum. At least one side of the arched structure extends horizontally to form the mounting portion, and the compressor is fixed on the mounting portion of the mounting platform.

In the above solution, the middle portion of the mounting platform is set to be of an arched structure protruding upwards in order to avoid collision with the second clothing treating drum at the bottom of the mounting platform. And one side of the mounting platform positioned at the arched structure is set as the mounting portion so as to mount the compressor at an edge position of the mounting platform. So that not only can fixing stability of the compressor be ensured, but also a mounting space on the mounting platform is fully utilized. A space for accommodating the compressor is defined by the mounting portion, the arched structure, and the first clothing treating drum.

Preferably, at least one side of the arched structure extends horizontally to form the mounting portion extending parallel to a lateral side of the frame. The compressor is horizontally mounted on the mounting platform along a direction in which the mounting portion extends, or the compressor is mounted on the mounting platform perpendicularly to a direction in which the mounting portion extends.

In the above solution, the frame comprises the lateral frames that fixes the side plates of the clothing treating device, i.e., lateral surfaces of the frame are formed. The direction in which the mounting portion extends is parallel to axes of the two clothing treating drums.

Preferably, the compressor is vertically fixed on the mounting platform via a fixing plate.

In the above solution, since the mounting portion is positioned at an edge of the mounting platform, i.e., on one side between the two clothing treating drums, the space therebetween is large enough to fix the compressor therein. Moreover, after the compressor is vertically fixed on the mounting portion, it is beneficial for saving a space on the mounting portion, and other devices or structures can be further mounted on the mounting portion.

Preferably, the fixing plate comprises a plate-shaped body and fixing support fixedly connected to the plate-shaped body. The fixing support is fixedly mounted on the mounting platform and the plate-shaped body is higher than the fixing support by a certain height, and the compressor is mounted on the plate-shaped body.

In the above solution, the fixing support raises the plate-shaped body to a certain height, so that the compressor is mounted in an off-contact form, which is beneficial for heat dissipation of the compressor.

Preferably, a bottom of the compressor is provided with a bottom support, and the plate-shaped body is provided with a connecting hole to be fixed to the bottom support of the compressor via a fastener. The fixing support comprises a plurality of connecting pieces respectively connected to the plate-shaped body. Each of the connecting pieces is bent towards an outer side of a top of the plate-shaped body to form a bent surface. Each of the bent surfaces is provided with connecting holes to be fixed to the mounting platform.

In the above solution, the fixing supports are fixed on the mounting portion on the peripheral side of the plate-shaped body, and stably fix the compressor fixed on the plate-shaped body.

Preferably, the plate-shaped body has a triangular structure, each of three corners of the triangular structure is provided with the connecting holes, the connecting holes correspond to the three bottom supports on the compressor respectively for connection and fixation via fasteners. The fixing support includes the connecting piece respectively connected with each of three edges of the triangular structure. The connecting piece is bent towards an outer side of a top of the triangular structure to form the bent surfaces, and each of the bent surfaces is provided with the connecting holes to be fixed on the mounting platform via the fasteners.

In the above solution, setting the plate-shaped body to be triangular not only saves a space but also achieves a good fixing effect.

Preferably, the bottom support of the compressor is higher than the bottom end of the compressor. A middle portion of the plate-shaped body is provided with a collision avoiding hole, the bottom end of the compressor abuts against the collision avoiding hole. The collision avoiding hole supports the compressor.

In the above solution, the bottom of the compressor is supported by the collision avoiding hole so as to fix and support the compressor better. A better stabilizing effect is achieved by supporting the compressor by the collision avoiding hole than supporting the compressor by the planar structure.

Preferably, the mounting portion is provided with an inwardly concave structure corresponding to the collision avoiding hole, and a gap is formed between a surface of the inwardly concave structure and the bottom end of the compressor, which is beneficial for heat dissipation of the compressor.

Preferably, the compressor comprises a cylindrical body and a liquid storage tank arranged on one side of the cylindrical body. One of the three bent surfaces on the peripheral side of the plate-shaped body is shorter than the other two bent surfaces so as to avoid collision with a bottom end of the liquid storage tank when the compressor is on the plate-shaped body.

By adopting the above technical solutions, the present disclosure have the following advantages compared with the prior art:

the objective of replacing and repairing parts of the frame may be achieved by setting the frame as the upper frame and the lower frame independent from each other. Meanwhile, the first clothing treating drum and the second clothing treating drum are respectively mounted in corresponding parts of the frame to achieve a modular management of the device. So that a device with only the second clothing treating drum and a device with both the first and second clothing treating drums may be produced on the same production line, thereby improving modularity of the device and reducing production cost.

Besides, the present disclosure has a simple structure and achieves a remarkable effect, and thus is suitable for popularization and use.

Notes to primary elements: 03—base; 05—upper vertical beam; 8—rear reinforcing member; 26—front reinforcing member of an upper drum; 27—upper reinforcing member; 28—rear fixing plate; 50—flange; 51—front side plate; 52—lateral side plate; 53—horizontal flange; 54—vertical flange; 1. frame; 11. vertical beam; 12. reinforcing member; 13. fixing frame; 131. first connecting plane; 132. second connecting plane; 133. fixing portion; 2. compressor; 21. liquid storage tank; 3. mounting platform; 31. collision avoiding portion; 32. mounting portion; 4. fixing plate; 41. plate-shaped body; 42. bent surface; 43. collision avoiding hole; 60. cooling fan.

DETAILED DESCRIPTION

The present disclosure will be further described in detail with reference to the following embodiments.

Embodiment 1

Figure 4:
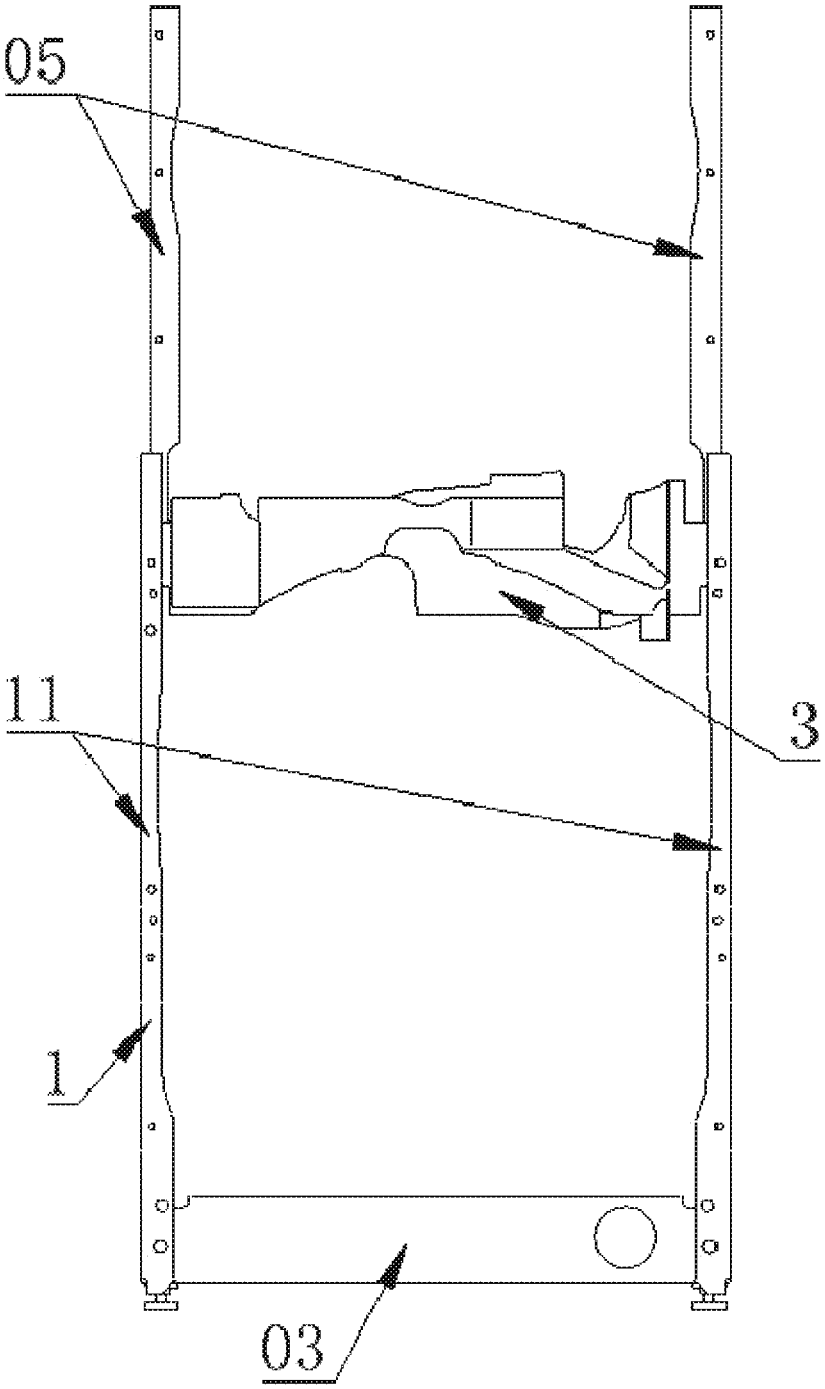
FIG. 4 is a structural schematic diagram of a frame of a clothing treating device according to an embodiment of the present disclosure.
Figure 5:
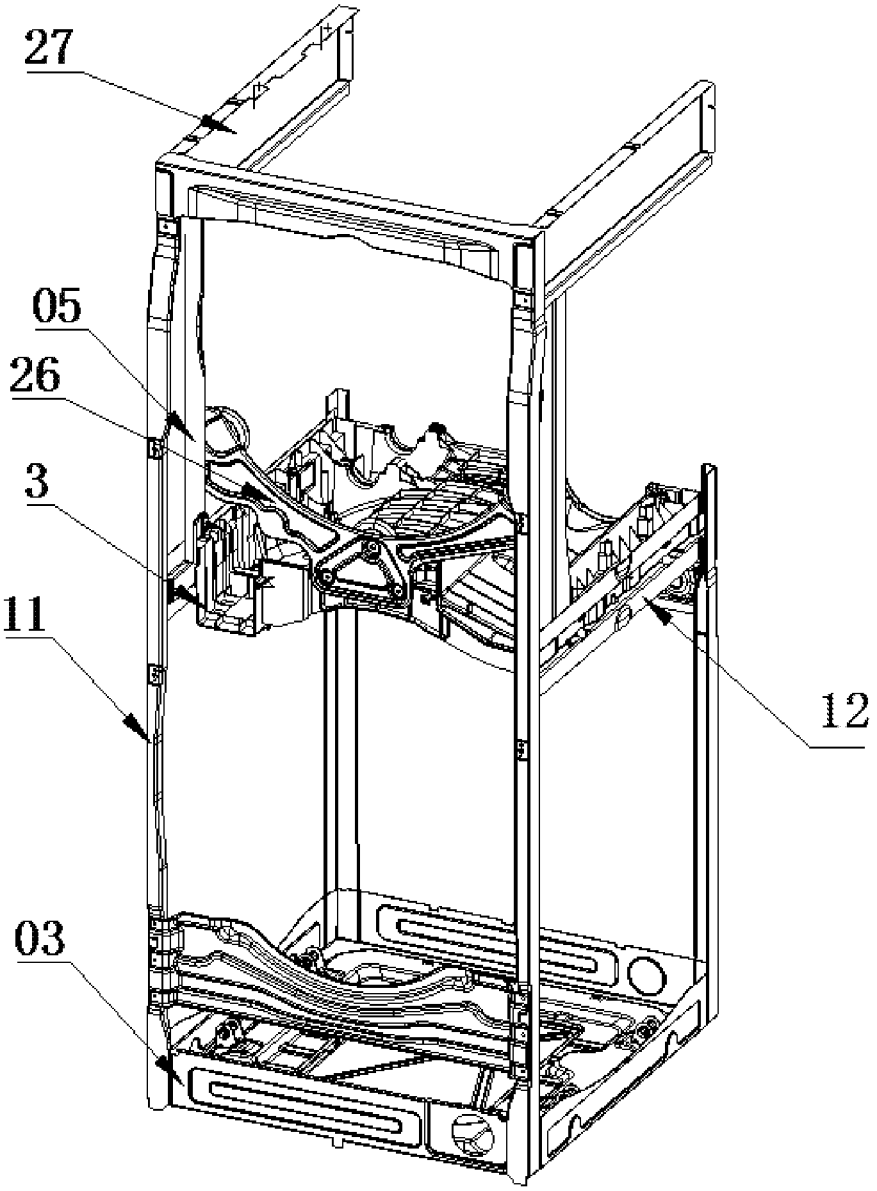
FIGS. 5 and 6 are schematic diagrams of a mounting structure of a clothing treating device from different perspectives according to an embodiment of the present disclosure.
Figure 6:
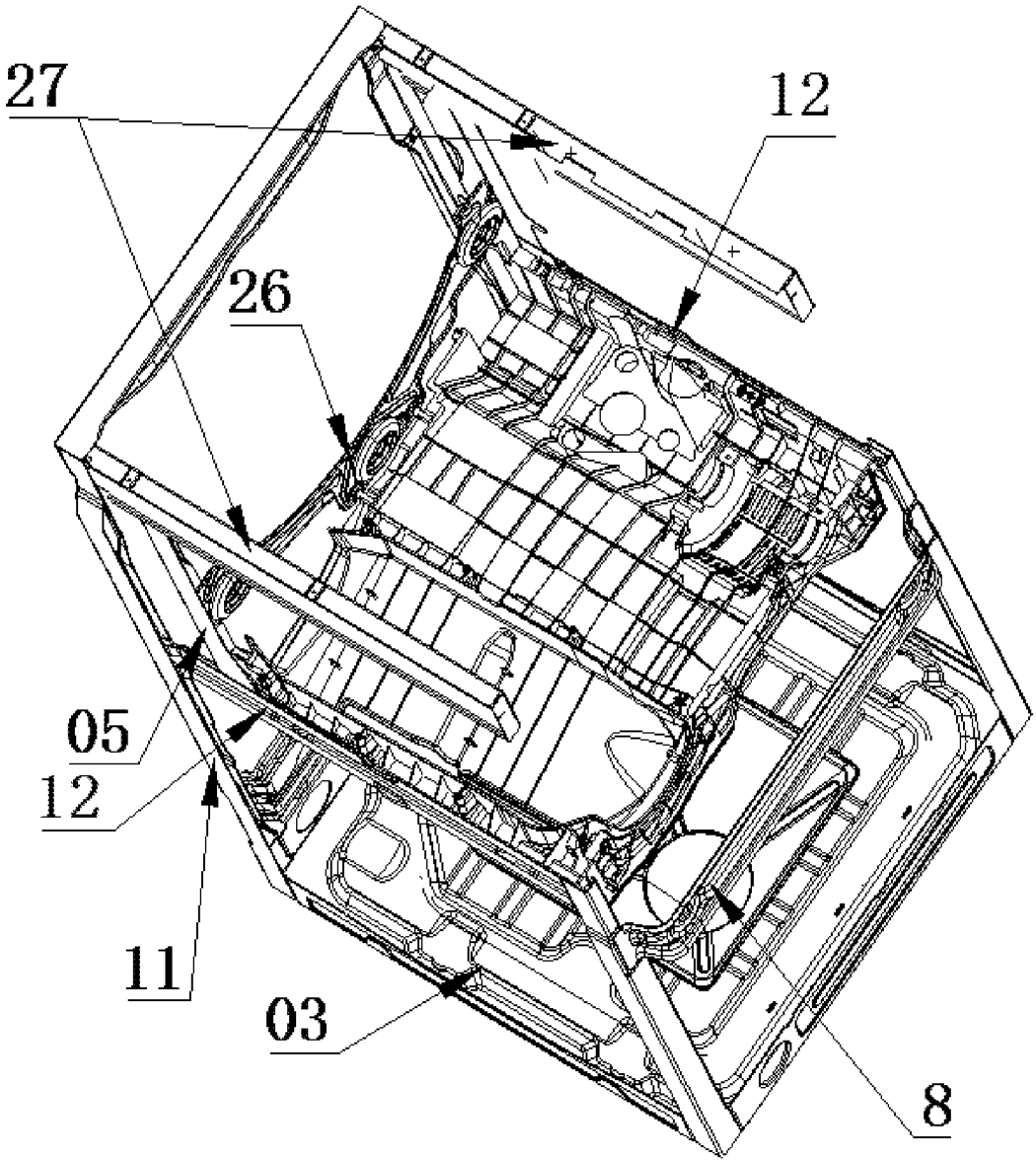
Figure 7:
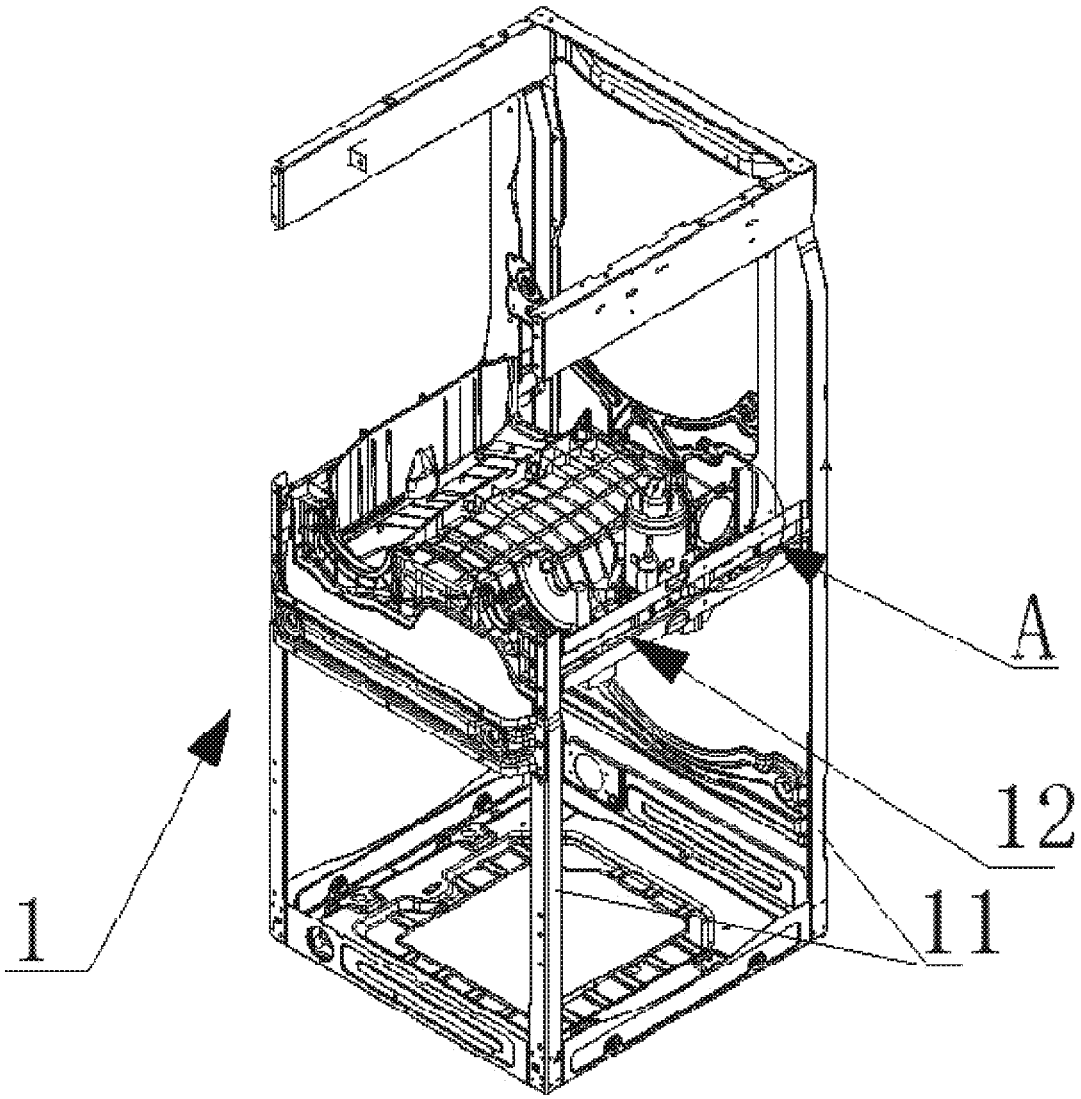
FIG. 7 is a diagram of a connecting structure of a frame and a mounting platform of a clothing treating device according to an embodiment of the present disclosure.
Figure 8:
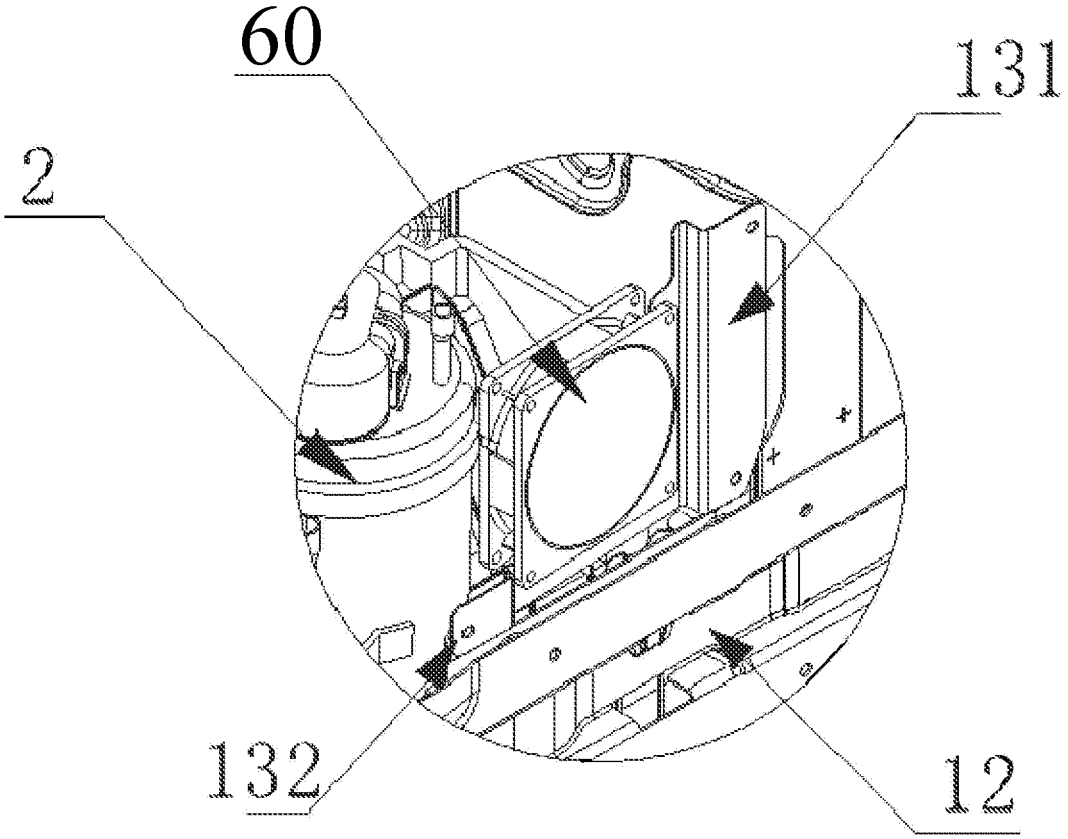
FIG. 8 is an enlarged view of a part A of FIG. 7.
Figure 9:
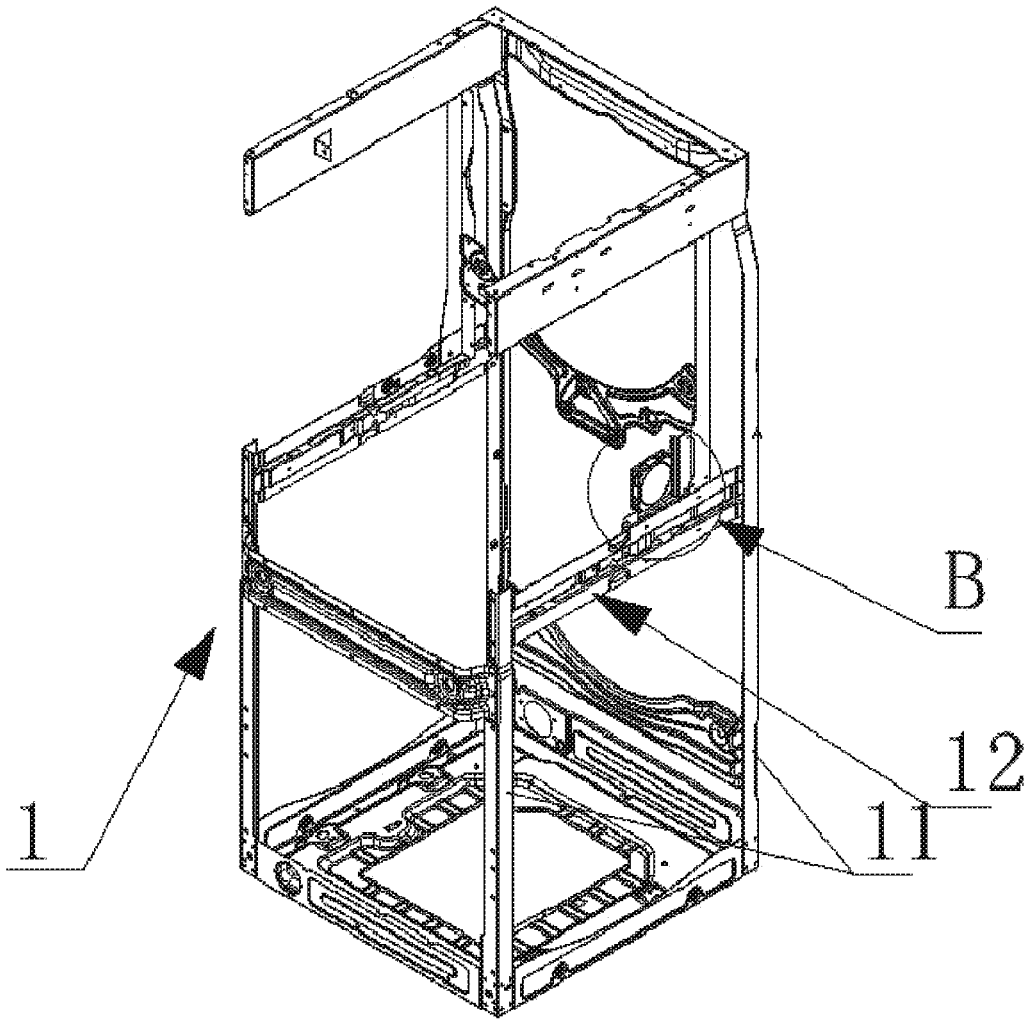
FIG. 9 is a structural schematic diagram of a frame of a clothing treating device according to an embodiment of the present disclosure.
Figure 10:
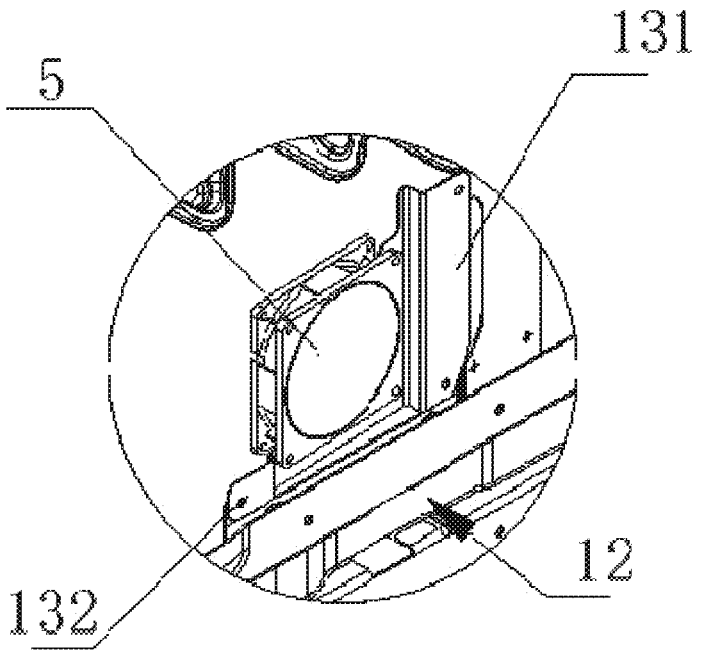
FIG. 10 is an enlarged view of a part B of FIG. 9.
Figure 11:
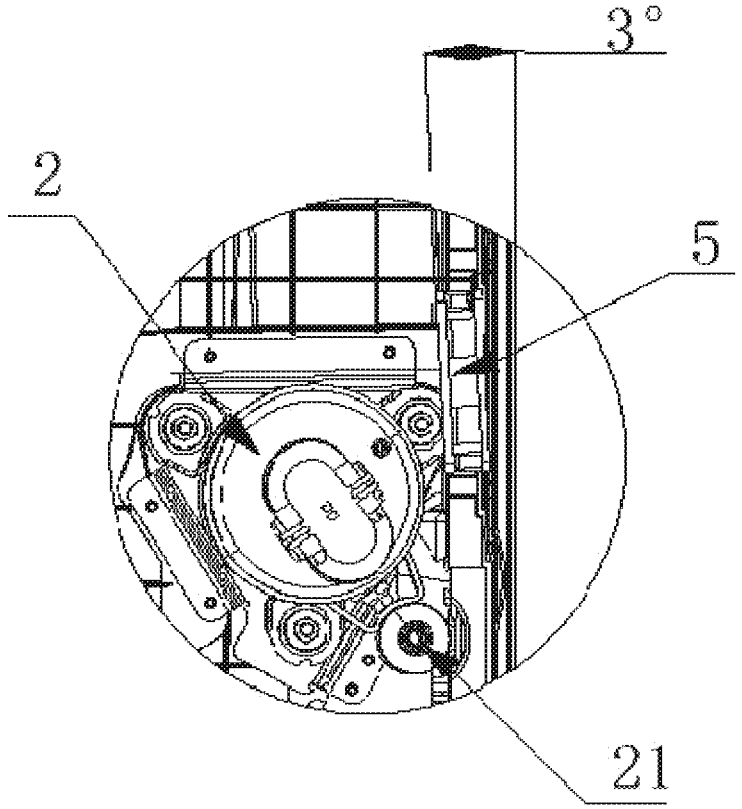
FIG. 11 is a diagram of cooperation between a compressor on a bottom platform and a cooling fan on a frame.
Figure 12:
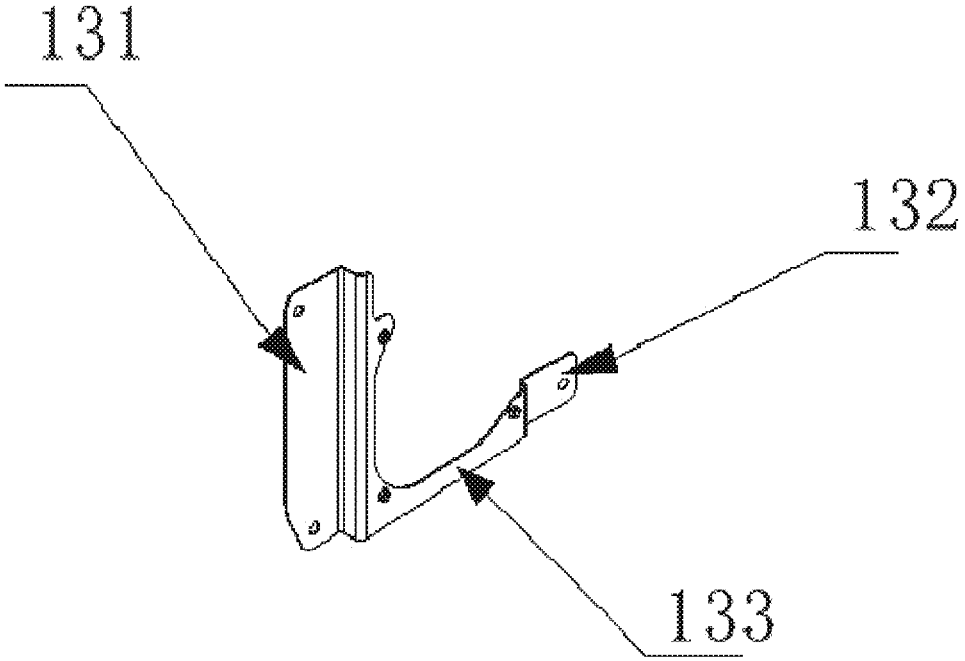
FIG. 12 is a structural schematic diagram of a fixing frame.
Figure 13:
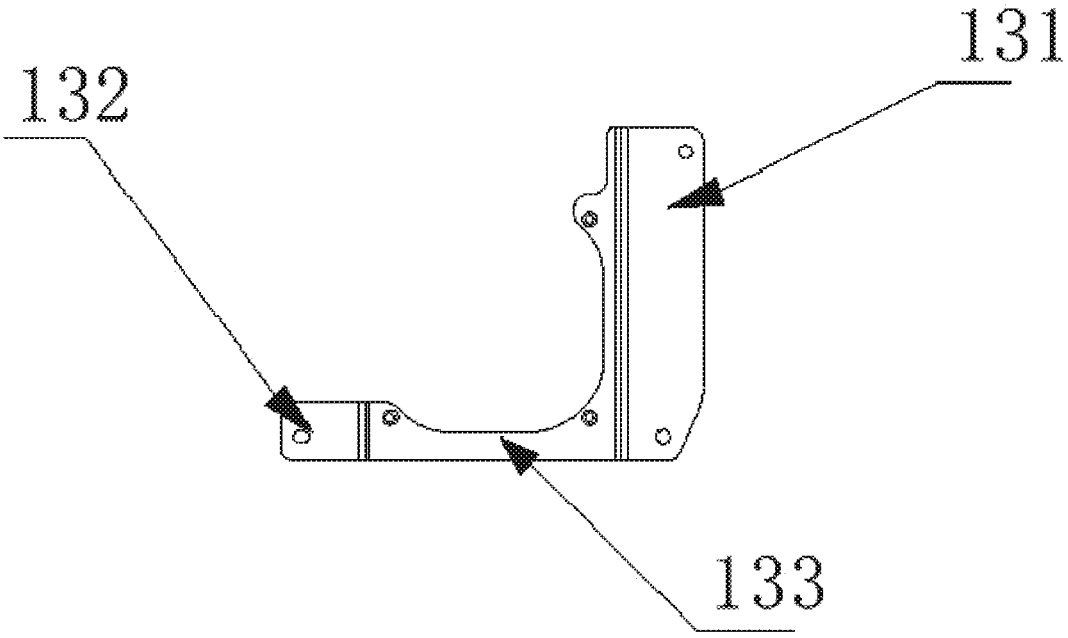
FIG. 13 is a front view of FIG. 12.
Figure 14:
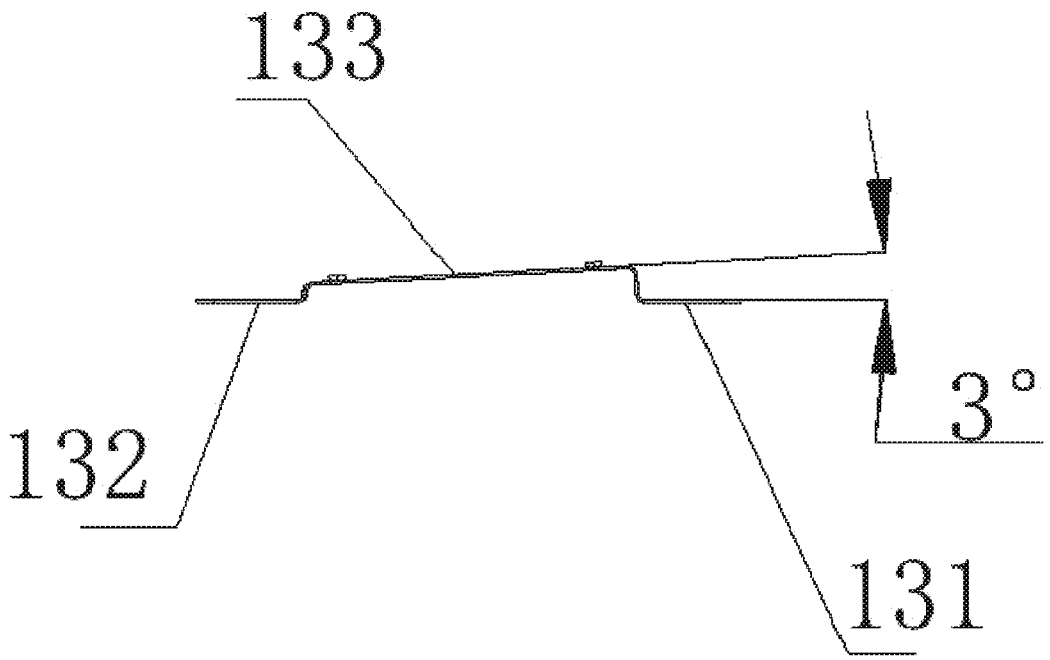
FIG. 14 is a top view of FIG. 12.
Figure 15:
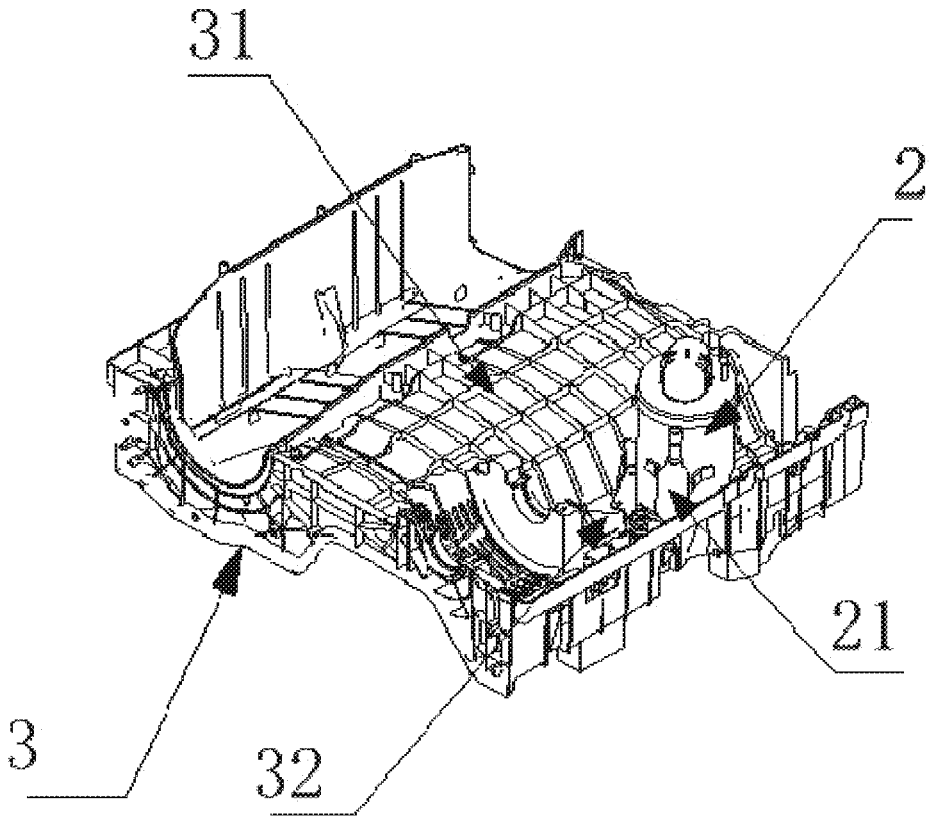
FIG. 15 is a structural schematic diagram of a mounting platform of a clothing treating device.
Figure 16:
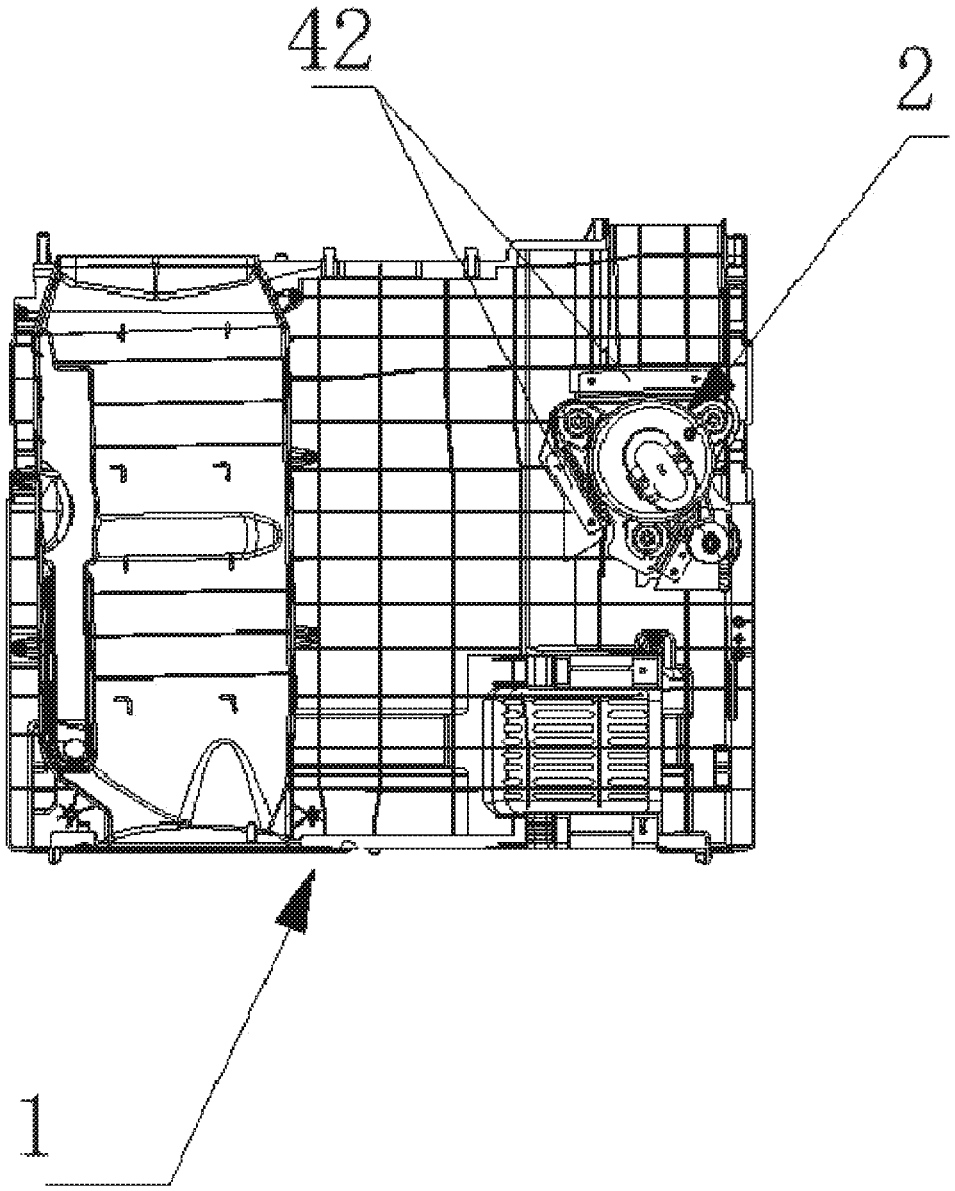
FIG. 16 is a top view of a mounting platform.
Figure 17:
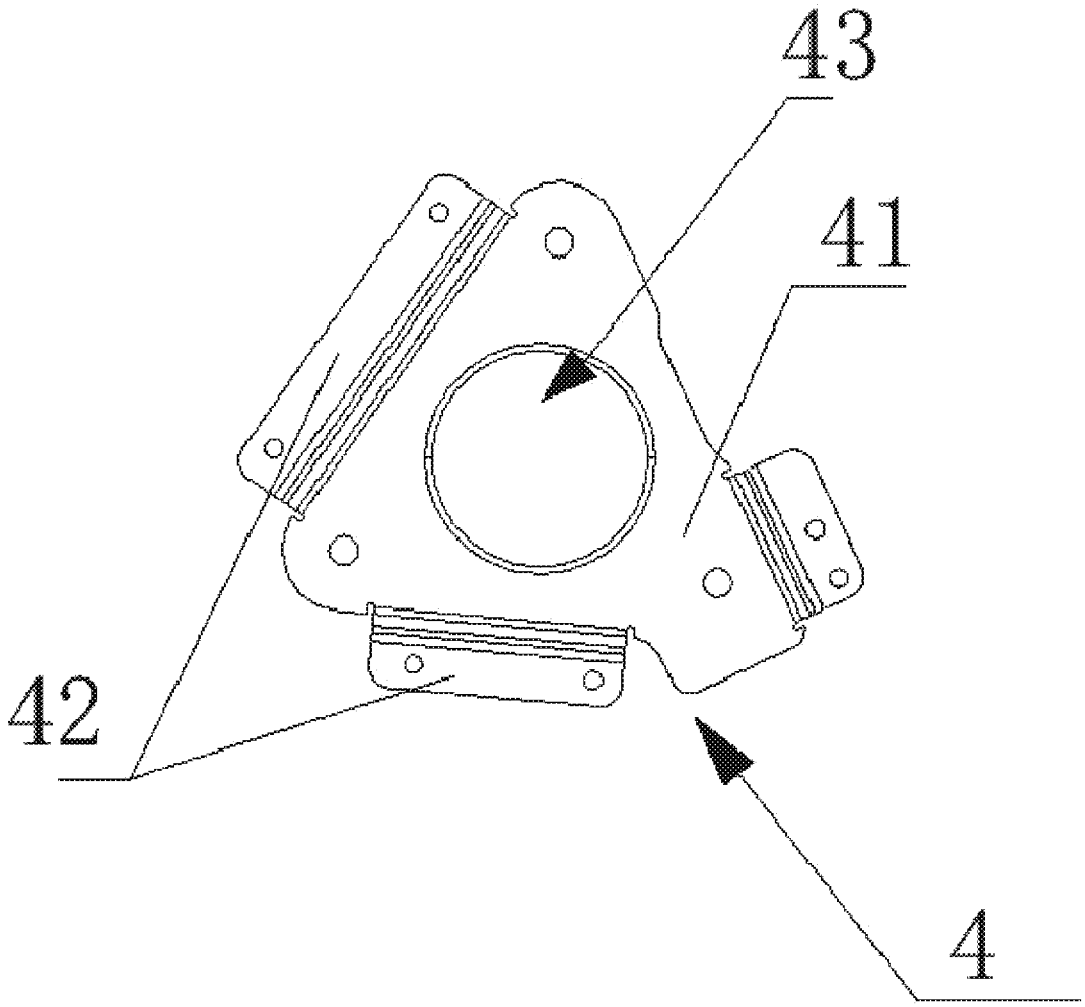
FIG. 17 is a top view of a fixing plate.
Figure 18:
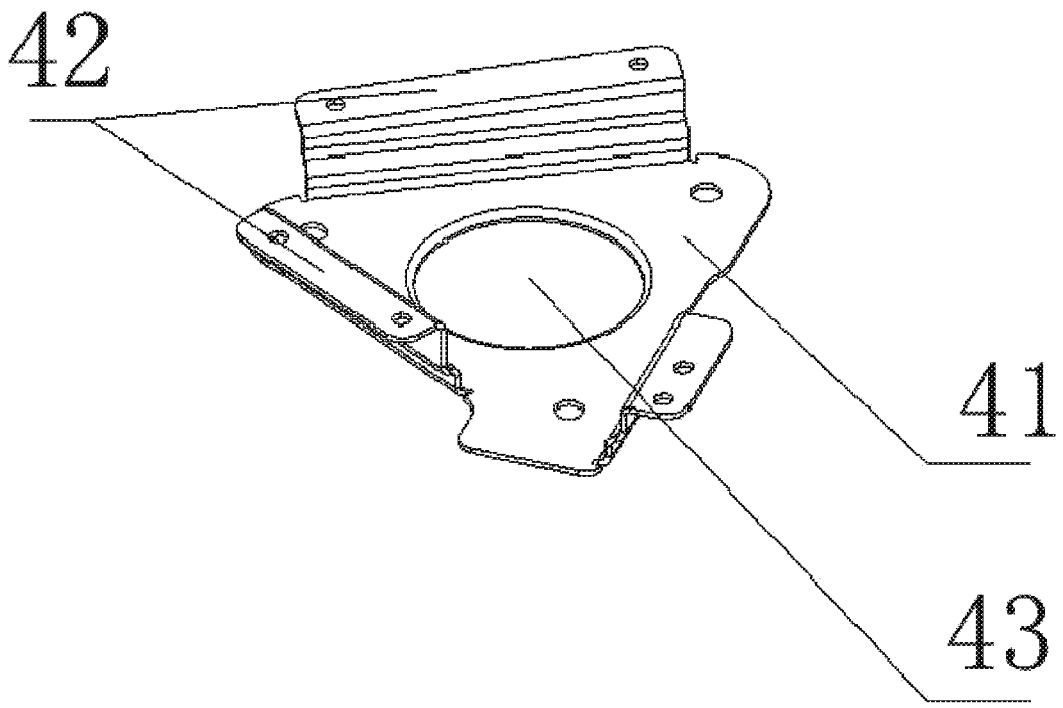
FIG. 18 is a schematic diagram of a stereo structure of a fixing plate.

As shown in FIGS. 4 to 6, an embodiment of the present disclosure introduces a frame structure of a clothing treating device. The clothing treating device comprises a frame 1, a first clothing treating drum and a second clothing treating drum arranged longitudinally. A mounting platform 3 is arranged between the first clothing treating drum and the second clothing treating drum and is fixedly connected with the frame 1 of the clothing treating device.

The mounting platform horizontally arranged is fixedly mounted at a middle portion of the frame, so that an upper clothing treating drum and a lower clothing treating drum of the clothing treating device are correspondingly mounted on different bases. Thereby further ensure that the two clothing treating drums may be separately supported effectively and fixedly mounted. In addition, the mounting platform is arranged between the first clothing treating drum and the second clothing treating drum for supporting and fixing the first clothing treating drum to isolate the two clothing treating drums, so that noise and vibration of the two clothing treating drums are separated from each other, thereby avoiding resonance and preventing occurrence of excessive noise and excessively severe vibration during machine operation.

In the embodiment, the frame 1 comprises a base 03 placed horizontally, and the base is square. Four corners of the base 03 are provided with vertical beams 11 extending vertically upwards. Two adjacent vertical beams 11 on a left side and two adjacent vertical beams 11 on a right side are respectively connected by middle reinforcing members 12, and the mounting platform 3 is fixedly mounted on the middle reinforcing members 12. Reinforcing members are arranged at the middle portions of the left and right sides of the frame in order to provide an effectively supporting plane for the mounting platform to thereby reliably mount and fix the mounting platform on the frame.

In the embodiment, the mounting platform 3 has a sheet-like structure horizontally extending, and left side and right side of the mounting platform 3 are respectively lapped on the middle reinforcing members 12 on the corresponding sides and fixedly connected therewith by screws.

In the embodiment, the middle reinforcing members 12 are strip-shaped sheets extending along a horizontal direction in a vertical plane. A left side wall and a right side wall of the mounting platform 3 are respectively attached to and in contact with inner side walls of the middle reinforcing members 12 of corresponding sides and are fixedly connected therewith by at least one screw at the corresponding attaching and contacting positions.

In the embodiment, middle portions of the middle reinforcing members 12 are provided with support moldings that protrude towards inside of the frame, the support moldings extend along the horizontal direction. A lower wall of a lateral portion of the mounting platform 3 is correspondingly lapped on upper side surfaces of the support moldings. By providing two relatively protruding support moldings on the middle reinforcing members, the mounting platform can be conveniently lapped on the upper side surfaces of the support moldings, thereby achieving a purpose of pre-positioning and mounting the mounting platform.

In the embodiment, front ends of the two middle reinforcing members 12 are respectively provided with upper vertical beams 05 extending vertically upwards. Lower ends of the upper vertical beams 05 are fixedly connected to the middle reinforcing members 12 and/or the mounting platform 3.

In the embodiment, a front reinforcing member of an upper drum 26 is mounted at the front end of the mounting platform 3, and is fixedly connected to two upper vertical beams 05 respectively. Preferably, the front reinforcing member 26 of the upper drum is an arch-shaped sheet bent upwards from a middle portion towards two ends respectively. The middle portion of the front reinforcing member 26 of the upper drum is fixedly connected with a middle portion of the front end of the mounting platform 3, and two ends of the front reinforcing member 26 of the upper drum are fixedly connected with the upper vertical beams 05 on the corresponding sides respectively.

In the embodiment, the upper vertical beams 05 are composed of strip-shaped sheets extending vertically with L-shaped cross sections. Inner sides of lower ends of the upper vertical beams 05 are attached to and in contact with outer side walls of corresponding corners of the mounting platform 3 sides, and the lower ends of the upper vertical beams 05 are correspondingly lapped on the support moldings arranged on the middle reinforcing members 12 on the corresponding sides. Preferably, corresponding attaching and contacting positions of the upper vertical beams 5 and the mounting platform 3 are fixedly connected by at least one screw.

Embodiment 2

Figure 1:
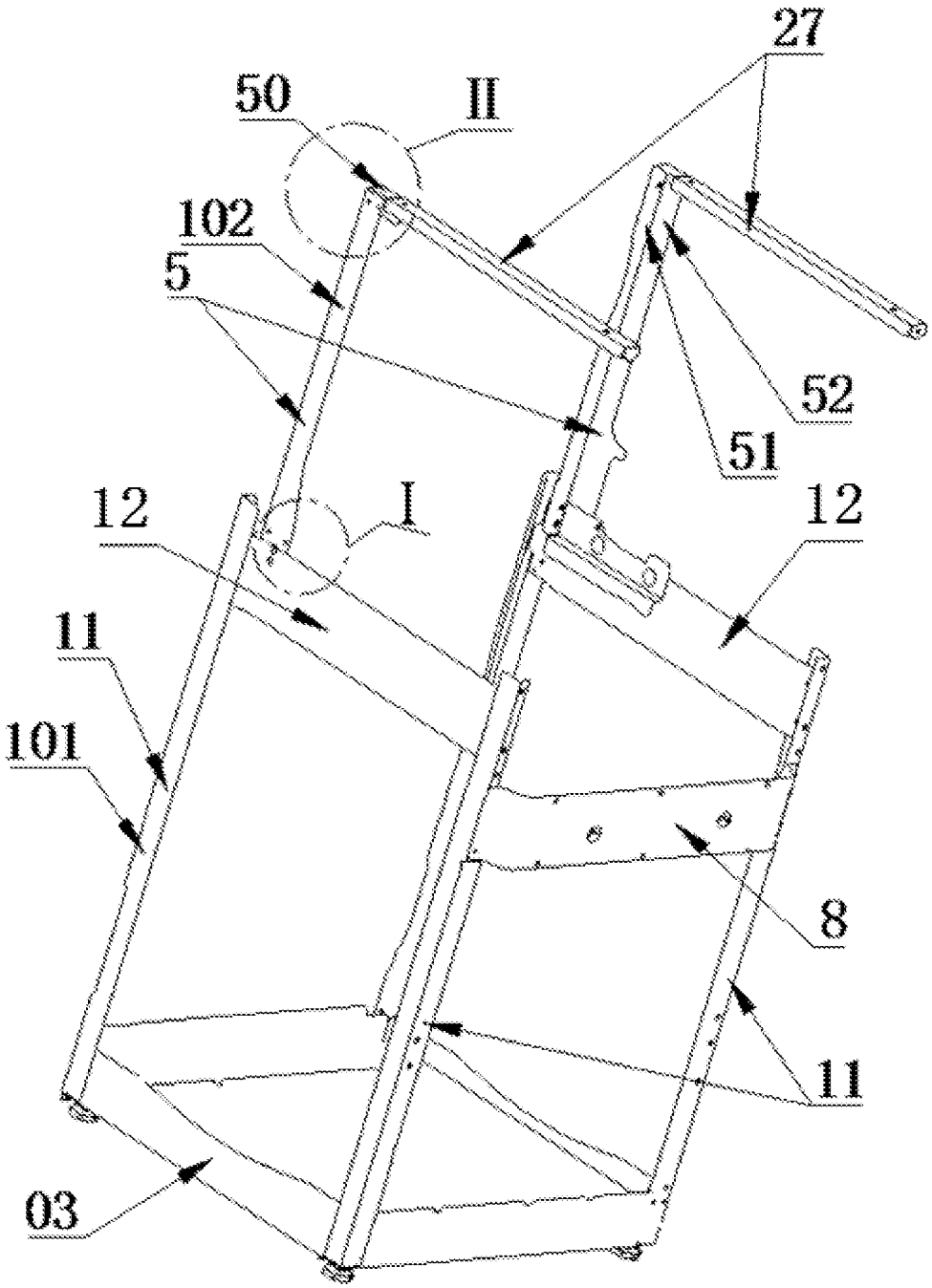
FIG. 1 is a schematic diagram of a structure of a frame of a clothing treating device according to an embodiment of the present disclosure.
Figure 2:
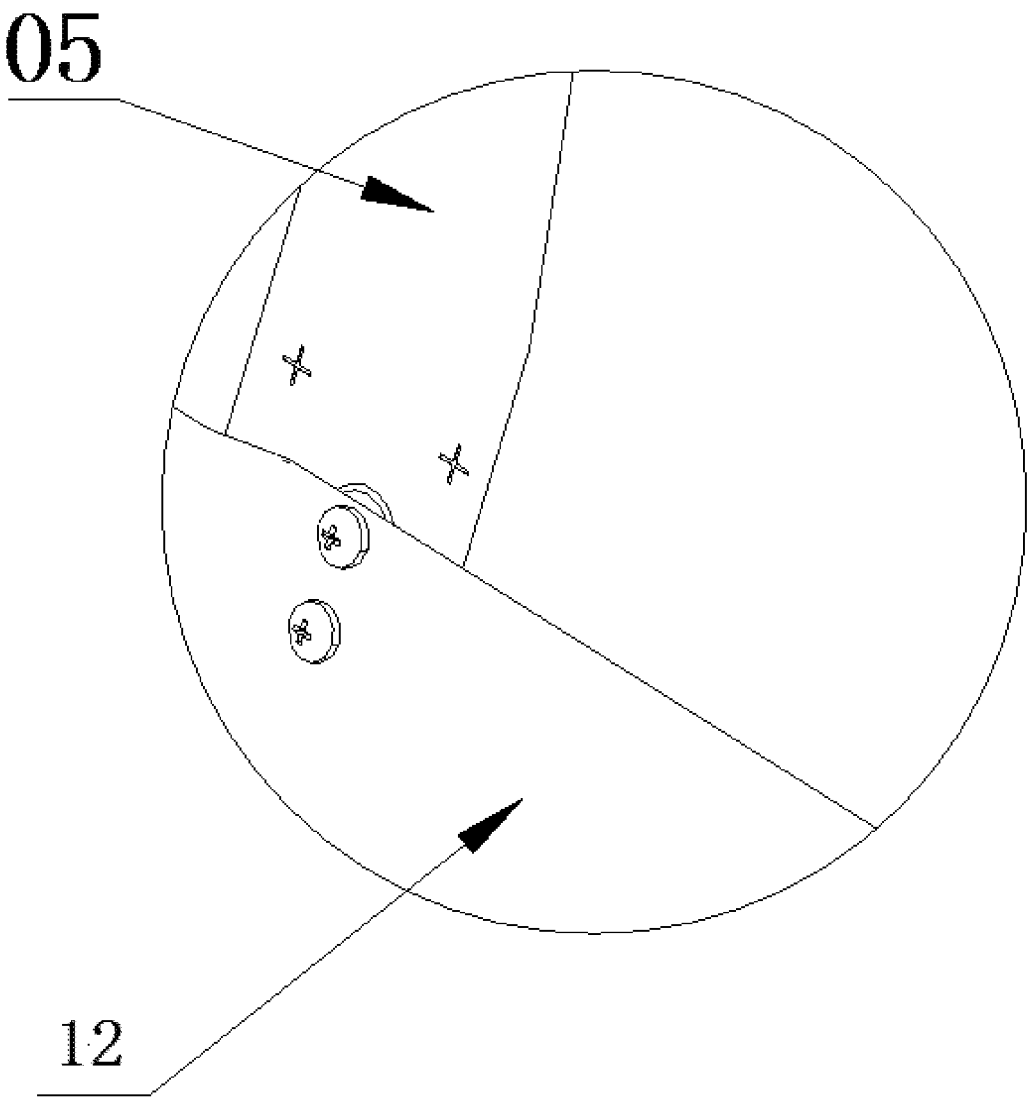
FIG. 2 is a schematic diagram of an enlarged structure of I in FIG. 1 according to an embodiment of the present disclosure.
Figure 3:
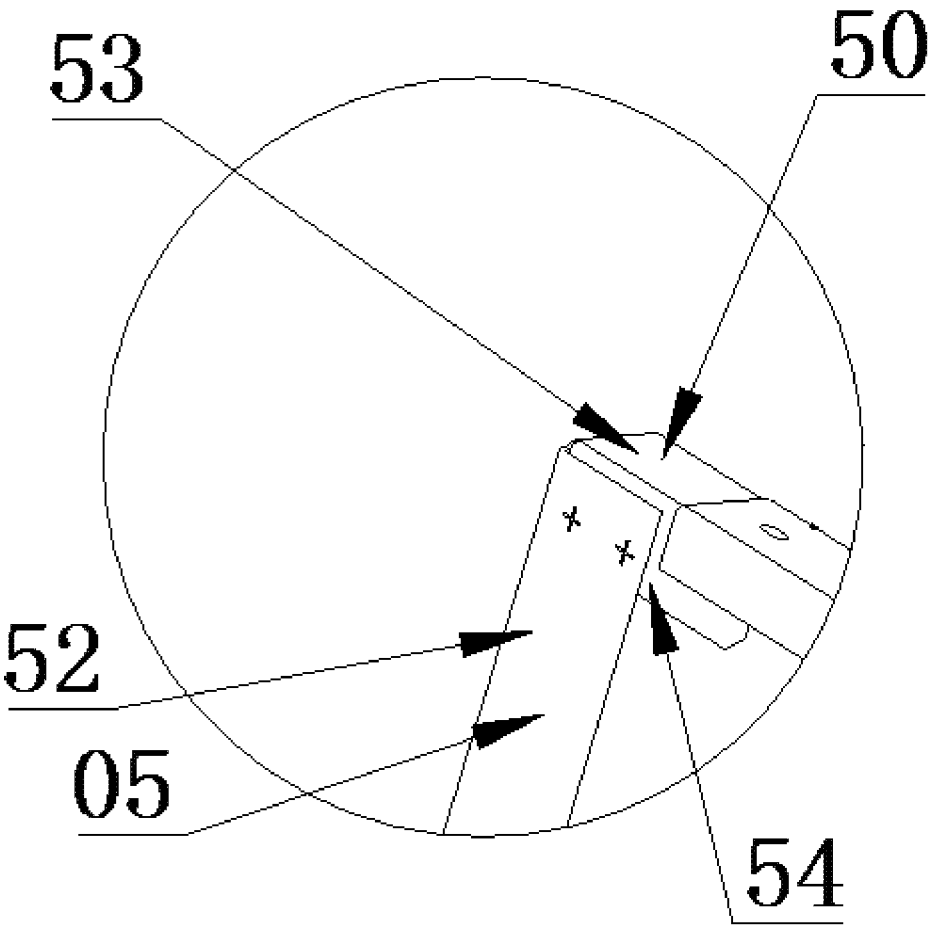
FIG. 3 is a schematic diagram of an enlarged structure of II in FIG. 1 according to an embodiment of the present disclosure.

As shown in FIGS. 1-3, the embodiment introduces a frame of a clothing treating device. The clothing treating device comprises a first clothing treating drum and a second clothing treating drum which are arranged in longitudinal order. The frame 1 comprises a lower frame 101 configured to place the second clothing treating drum. An upper frame 102 extending upwards is mounted on a top of the lower frame 101, and is configured to mount the first clothing treating drum.

The objective of replacing and repairing parts of the frame may be achieved by setting the frame as the upper frame and the lower frame independent from each other. Meanwhile, the first clothing treating drum and the second clothing treating drum are respectively mounted in corresponding parts of the frame in order to realize a modular management of the device. So that a device with only the second clothing treating drum and a device with both the first and second clothing treating drums may be produced on the same production line, thereby improving modularity of the device and reducing production cost.

As shown in FIG. 1, in the embodiment, the lower frame 101 comprises a base 03 placed horizontally, and the base is square. Four corners of the base 03 are respectively provided with vertical beams 11 extending vertically upwards. At least one pair of adjacent vertical beams 11 is fixed via a middle reinforcing member 12 to enclose a frame structure for mounting the second clothing treating drum. Preferably, adjacent vertical beams on a left side are fixedly connected respectively via a left middle reinforcing member, and adjacent vertical beams on a right side are fixedly connected respectively via a right middle reinforcing member. Further preferably, the left middle reinforcing member and the right middle reinforcing member are arranged symmetrically.

In the embodiment, the upper frame 102 comprises two upper vertical beams 05 extending vertically upwards arranged at a left end and a right end near a front side of the frame. Lower ends of the two upper vertical beams 05 are both fixedly connected with the lower frame 101, and tops of the two upper vertical beams 05 are respectively connected with upper reinforcing members 27 extending rearwards of the frame.

In the embodiment, the lower ends of the upper vertical beams 05 of the upper frame 102 are fixedly connected with the middle reinforcing members 12 of the lower frame 101 and/or upper ends of the vertical beams 11.

As shown in FIG. 2, in the embodiment, the lower ends of the upper vertical beams 05 are correspondingly attached to and in contact with the middle reinforcing members 12 and/or the upper ends of the vertical beams 11 and are fixedly connected therewith by screws. Preferably, outer sides of the lower ends of the upper vertical beams 05 and inner sides of the middle reinforcing members 12 are correspondingly attached. The upper vertical beams 05 are fixedly connected with the middle reinforcing members 12 by two longitudinally arranged screws connected at the attaching and contacting positions. By attaching the lower ends of the upper vertical beams and the middle reinforcing members at a predetermined position and then performing fastening, assembling and connecting via screws, assembling stability and mounting efficiency of the upper vertical beams and the lower frame are significantly improved.

As shown in FIG. 3, in the embodiment, top ends of the upper vertical beams 05 are provided with flanges 50 bent horizontally rearwards, and end portions of the upper reinforcing members 27 are correspondingly lapped on upper sides of the flanges 50 in an attaching manner and fixedly connected therewith via screws. Preferably, each of the upper vertical beams 05 having L-shaped cross sections is composed of a front side plate and a lateral side plate in strip shape, the front side plate 51 is parallel to or overlapped with a front side of the frame 1 and the lateral side plate 52 is parallel to or overlapped with a lateral portion of the frame 1. An upper end of the lateral side plate 51 is provided with a notch extending horizontally, an upper end of the front side plate 52 is provided with a fold line extending horizontally. The fold line and the notch are arranged to be aligned with the notch so that the flanges 50 are formed by bent portions, formed by rearwards bending upper ends of the upper vertical beams by 90° around the fold lines, of the upper vertical beams 05.

In the embodiment, the flanges 50 comprise horizontal flanges 53 horizontally bent rearwards by tops of the front side plates of the upper vertical beams 05 and vertical flanges 54 vertically bent downwards by lateral portions of the horizontal flanges. The vertical flanges 54 and the lateral side plates 52 of the upper vertical beams 05 are correspondingly arranged in an attaching manner and riveted to be fixed. The end portions of the upper reinforcing members 27 are lapped on upper sides of the horizontal flanges 53 and connected therewith via screws. Preferably, rearward extending lengths of the horizontal flanges 53 are greater than horizontal widths of the lateral side plates 52 of the upper vertical beams 05, so that the end portions of the horizontal flanges 53 protrude from the upper vertical beams 05 and are provided for attaching and lapping the upper reinforcing members 27.

In the embodiment, the upper reinforcing members 27 have strip-shaped structures with L-shaped cross sections, and inner walls of the upper reinforcing members 27 are correspondingly in contact with the upper sides of the horizontal flanges 53 and outer sides of the vertical flanges 54 respectively in a limiting manner. By attaching the upper reinforcing members correspondingly at the corresponding flanges, assembly support points of the upper reinforcing members are improved, thereby significantly improving stability of the entire device.

In the embodiment, a rear side of the lower frame 101 is further provided with a middle rear reinforcing member 8. The middle rear reinforcing member 8 extends horizontally, and two ends of the middle rear reinforcing member 8 are respectively fixedly connected with upper portions of the two vertical beams 11 at the rear side.

In the embodiment, rear ends of the two upper reinforcing members 27 are respectively configured to connect with a mounting plate 28 of the first clothing treating drum. The lower frame is configured to fixedly connect with a lower end of the rear fixing plate. By means of the above setting, the first clothing treating drum having only a drying function in the upper portion is correspondingly mounted in the upper frame and a seal fixation of a rear side of an upper portion of a machine body is also ensured, so that the rear fixing plate of the first clothing treating drum has functions of connecting the reinforcing members as well as forming part of the frame.

Embodiment 3

As shown in FIGS. 7-17, the embodiment provides a clothing treating device including a heat pump system, a frame 1 and a mounting platform 3 mounted on the frame 1. The heat pump system comprises a compressor 2 mounted on the mounting platform 3, and a cooling fan 60 fixed on the frame 1 and arranged corresponding to the compressor 2.

In the above solution, in consideration of the problem of a small internal space of the mounting platform 3, the cooling fan 60 is fixed on the frame 1, thereby saving a mounting space on the mounting platform 3. Moreover, by fixing the cooling fan 60 on the frame 1, the cooling fan 60 is closer to a case of the clothing treating device, thereby improving a ventilation effect and being beneficial for cooling the compressor 2.

Preferably, the frame 1 comprises a lateral frame for fixing a side plate of the clothing treating device, and the cooling fan 60 is fixed on the lateral frame.

In the above solution, the cooling fan 60 is mounted on the lateral frame of the frame 1, and then a vent is formed in one side plate of the case of the clothing treating device without a need of forming a vent on a front panel of the clothing treating device. So that an integral structure of the front panel of the entire machine is maintained, thereby making the front panel integral, benefiting aesthetics of the front panel and playing a significant role in improving aesthetics of the clothing treating device.

Preferably, the lateral frame comprises two vertical beams 11 vertically arranged. A reinforcing member 12 is connected between the two vertical beams 11, and the cooling fan 60 is fixed on the reinforcing member 12 and/or one of the two vertical beams 11.

In the above solution, two sides of the frame 1 are respectively provided the lateral frame. The lateral frame is provided with two vertical beams 11 and the reinforcing member 12 connecting the two vertical beams 11, and the cooling fan 60 is fixed on the reinforcing member 12 on one side of the frame 1.

Preferably, a mounting portion 32 is arranged on one side of the mounting platform 3 close to the reinforcing members 12. The compressor 2 is fixed to the mounting portion 32, and the cooling fan 60 is fixed on the reinforcing member 12 and/or the vertical beam 11 and is arranged opposite to the compressor 2.

In the above solution, the mounting portion 32 is arranged on one side of the mounting platform 3 close to the reinforcing members 12, so that the compressor 2 is mounted at an edge position of the mounting platform 3, thereby being not only beneficial for cooling the compressor 2 by the cooling fan 60, but also suitable for the structure of the mounting platform 3.

Preferably, the cooling fan 60 is arranged on the reinforcing member 12 directly facing to the compressor 2.

Or, the cooling fan 60 is arranged on the reinforcing member 12 in staggered management with the compressor 2, and a suction surface of the cooling fan 60 is arranged directly facing to the compressor 2.

Preferably, a first clothing treating drum and a second clothing treating drum are mounted longitudinally in the frame 1. The mounting platform 3 is fixed between the first clothing treating drum and the second clothing treating drum in the frame 1. A middle portion of the mounting platform 3 is protruded towards the first clothing treating drum to form a collision avoiding portion 31 for avoiding collision with the second clothing treating drum. One side, on the mounting platform 3, of the collision avoiding portion 31 is arranged in a planar structure to form the mounting portion 32. The compressor 2 is mounted on the mounting portion 32, and the cooling fan 60 is fixed on the reinforcing member 12 and/or the vertical beam 11, close to the one side of the mounting portion 32, of the frame 1.

In the above solution, the reinforcing members 12 are further connected to spring assemblies of the second clothing treating drum in a hooking manner. The two reinforcing members 12 on the two sides of the frame 1 hook the two spring assemblies on the two sides of the second clothing treating device respectively. The reinforcing members 12 are further used to connect and fix the mounting platform.

Preferably, the cooling fan 60 is fixed on the frame 1 by a fixing frame 13. The fixing frame 13 comprises a fixing portion 133 for mounting the cooling fan 60 and a connecting portion for connecting and fixing to the reinforcing members 12 and/or the vertical beams 11. The fixing portion 133 is inclined towards the compressor 2 so that the suction surface of the cooling fan 60 is arranged directly facing to the compressor 2.

In the above solution, when the cooling fan 60 and the compressor 2 are mounted in a staggered manner, the fixing portion 133 on the fixing frame 13 is inclined towards the compressor 2, so that after the compressor 2 is mounted on the fixing portion 133, the suction surface of the cooling fan 60 is arranged directly facing to the compressor 2.

Preferably, the connecting portion of the fixing frame 13 is positioned on two sides of the fixing portion 133. The connecting portion at one side of the fixing portion is fixed to the reinforcing member 12, and the connecting portion at the other side of the fixing portion is fixed to one vertical beam arranged in front of the frame and connected with the reinforcing member 12.

In the above solution, in order to stably fix the cooling fan 60, the fixing frame 13 and the compressor 2 are mounted in a staggered manner, and are respectively connected to the vertical beams 11 of the front portion of the frame 1 and the reinforcing members connected with the vertical beams 11 via the connecting portion. Such a structure may achieve an effect of stably fixing the cooling fan 60.

Preferably, the fixing frame 13 has a sheet-like structure, and a partial surface of the sheet-like structure is inclined towards the compressor 2 and protrudes to form the fixing portion 133 for fixing the cooling fan 60. A portion of the frame 1 positioned on an edge of the fixing portion 133 is the connecting portion.

The connecting portion of the fixing frame 13 has a sheet-like structure, which is attached and fixed to the lateral frame on one side of the frame 1 and is parallel to the surface of the lateral frame. The fixing portion 133 also has a sheet-like structure, a surface of the sheet-like structure is inclined towards the compressor 2 so that the surface of the fixing portion 133 and a surface of the connecting portion are set to form a certain included angle, and the fan, after being mounted on the fixing portion 133, forms an included angle of 3° with the lateral frame of the frame 1.

Preferably, a contour surface of the fixing portion 133 having the sheet-like structure is provided with a notch matched with the cooling fan 60 in shape, and the cooling fan 60 is mounted and fixed at the notch. Preferably, the contour surface of the fixing portion 133 has an L-shaped structure; the cooling fan 60 has a square plate-like structure. Edges of two adjacent sides of the cooling fan 60 are respectively fixed to edges of two inner sides of the L-shaped structure via fasteners.

Preferably, an edge of the surface of the fixing portion 133 positioned at the notch is provided with connecting holes so as to be fixed to the cooling fan 60 via fasteners.

Further, the fixing portion 133 having the L-shaped structure comprises a vertical plane extending in a vertical direction and a horizontal plane extending in a horizontal direction. The connecting portion comprises a first connecting plane 131 and a second connecting plane 132 which are connected with the vertical plane and the horizontal plane respectively. The first connecting plane 131 is fixed to the vertical beam 11 on one side of the front portion of the frame 1, the second connecting plane 132 is fixed to the reinforcing member 12 connected with the vertical beam 11. The cooling fan 60 is mounted on a surface of the fixing portion 133 protruding from a portion between the first connecting plane 131 and the second connecting plane 132.

Embodiment 4

Referring to FIGS. 7-18, Embodiment 4 depicts the clothing treating device of the present disclosure from another angle. The clothing treating device in Embodiment 4 also comprises a frame 1 and a first clothing treating drum and a second clothing treating drum respectively mounted in the frame 1. The clothing treating device further comprises a heat pump system and a mounting platform 3. The mounting platform 3 is fixed in the frame 1 and positioned between the first clothing treating drum and the second clothing treating drum. The mounting platform 3 comprises a collision avoiding portion 31 partially protruding and a mounting portion 32 in a planar arrangement. The heat pump system comprises a compressor 2 fixed on the mounting portion 32 of the mounting platform 3.

In the above solution, the mounting platform 3 is provided with the collision avoiding portion 31 protruding corresponding to the second clothing treating drum at a bottom of the mounting platform 3. The design of the collision avoiding portion 31 is not beneficial for mounting and fixing the compressor 2. Therefore, in the present disclosure, a mounting structure of the compressor 2 is improved adaptively according to a completely new structure of the mounting platform 3, thereby not only ensuring fixing stability of the compressor 2 but also saving a mounting space of the mounting platform 3.

Preferably, the first clothing treating drum and the second clothing treating drum are mounted longitudinally in the frame 1. The collision avoiding portion 31 is of an arched structure, protruding upwards, of a surface of the mounting platform 3 protruding upwards corresponding to a top of the second clothing treating drum. At least one side of the arched structure extends horizontally to form the mounting portion 32, and the compressor 2 is fixed on the mounting portion 32 of the mounting platform 3.

In the above solution, a middle portion of the mounting platform 3 is set to be of an arched structure protruding upwards in order to avoid collision with the second clothing treating drum below the mounting platform 3. One side of the mounting platform 3 positioned at the arched structure is set as the mounting portion 32 so as to mount the compressor 2 at an edge position of the mounting platform 3, thereby not only ensuring fixing stability of the compressor 2 but also making full use of a mounting space on the mounting platform 3. A space for accommodating the compressor 2 is defined by the mounting portion 32, the arched structure, and the first clothing treating drum.

Preferably, at least one side of the arched structure extends horizontally to form the mounting portion 32 extending parallel to a lateral surface of the frame 1. The compressor 2 is horizontally mounted on the mounting platform 3 along a direction in which the mounting portion 32 extends, or the compressor 2 is vertically mounted on the mounting platform 3 perpendicularly to a direction in which the mounting portion 32 extends.

In the above solution, the frame 1 comprises lateral frames that fix side plates of the clothing treating device, i.e., lateral surfaces of the frame 1 are formed. The extending direction of the mounting portion 32 is parallel to axes of the two clothing treating drums.

Preferably, the compressor 2 is vertically fixed on the mounting platform 3 via a fixing plate 4.

In the above solution, since the mounting portion 32 is positioned at the edge position of the mounting platform 3, i.e., on one side between the two clothing treating drums, the space therebetween is large enough to fix the compressor 2 therein. Moreover, after the compressor 2 is vertically fixed on the mounting portion 32, it is beneficial for saving a space on the mounting portion 32, and other devices or structures can be further mounted on the mounting portion 32.

Preferably, the fixing plate 4 comprises a plate-shaped body 41 and a fixing support fixedly connected to the plate-shaped body 41. The fixing support is fixedly mounted on the mounting platform and the plate-shaped body is higher than the fixing support by a certain height, and the compressor 2 is mounted on the plate-shaped body 41.

In the above solution, the fixing support raises the plate-shaped body 41 to a certain height, so that the compressor 2 is mounted in an overhead form, thereby being beneficial for heat dissipation of the compressor 2.

Preferably, a bottom of the compressor 2 is provided with a bottom support, and the plate-shaped body 41 is provided with a connecting hole to be fixed to the bottom support of the compressor 2 by via a fastener. The fixing support includes a plurality of connecting pieces respectively connected to the plate-shaped body 41. Each of the connecting pieces is bent towards an outer side of a top of the plate-shaped body 41 to form a bent surface 42. Each of the bent surfaces 42 is provided with a connecting hole to be fixed to the mounting platform 3.

In the above solution, the fixing support is fixed to the mounting portion 32 on a peripheral side of the plate-shaped body 41, and stably fix the compressor 2 fixed on the plate-shaped body.

Preferably, the plate-shaped body 41 has a triangular structure, each of three corners of the triangular structure is provided with the connecting hole, three the connecting holes correspond to the three bottom supports on the compressor 2 respectively for connection and fixation via fasteners. The fixing support includes the connecting pieces respectively connected with three sides of the triangular structure. Each of the connecting pieces is bent towards an outer side of a top of the triangular structure to form the bent surfaces 42. Each of the bent surfaces 42 is provided with the connecting hole to be fixed to the mounting platform 3 via the fasteners.

In the above solution, setting the plate-shaped body 41 to be triangular not only saves a space but also has a good fixing effect.

Preferably, the bottom supports of the compressor 2 are higher than a bottom end of the compressor 2. A middle portion of the plate-shaped body 41 is provided with a collision avoiding hole 43, the bottom end of the compressor 2 abuts against the collision avoiding hole 43, and the collision avoiding hole 43 supports the compressor 2.

In the above solution, the collision avoiding hole 43 is provided to support the bottom end of the compressor 2, so as to fix and support the compressor 2 better. A better stabilizing effect is achieved by supporting the compressor 2 by the collision avoiding hole than supporting the compressor 2 by the planar structure.

Preferably, an inwardly concave structure is arranged on the mounting portion 32 corresponding to the collision avoiding hole 43. A gap is formed between a surface of the inwardly concave structure and the bottom end of the compressor 2, which is beneficial for heat dissipation of the compressor 2.

Preferably, the compressor 2 comprises a cylindrical body and a liquid storage tank 21 arranged on one side of the body. One of the three bent surfaces 42 on the peripheral side of the plate-shaped body 41 is shorter than the other two bent surfaces to avoid collision with a bottom end of the liquid storage tank 21 when the compressor 2 is fixed on the plate-shaped body 41.

It should be noted that technical solutions disclosed by Embodiment 1 and Embodiment 2 of the present disclosure may be either combined to form a new technical solution or separately carried out, which is not limited herein.

Solutions for carrying out the above embodiments may be further combined or replaced, and the embodiments are merely used to describe the preferred embodiments of the present disclosure rather than limiting the concept and scope of the present disclosure. Without departing from the spirit of the design of the present disclosure, variations and improvements to the technical solutions of the present disclosure by those skilled in the art all fall into the protection scope of the present disclosure.

The invention claimed is:

1. A frame of a clothing treating device, wherein the clothing treating device includes a first clothing treating drum and a second clothing treating drum, wherein the frame comprises:

a lower frame configured to place the second clothing treating drum;

an upper frame extending upwards is mounted on a top of the lower frame and configured to place the first clothing treating drum, wherein the upper frame includes two upper vertical beams extending vertically upwards arranged respectively at a first end and a second end of a front side of the upper frame, lower ends of the two upper vertical beams are both fixedly connected with the lower frame, and top ends of the two upper vertical beams are provided with flanges bent horizontally rearwards; and upper reinforcing members, wherein end portions of the upper reinforcing members are correspondingly attached on upper sides of the flanges, wherein each of the upper vertical beams have an L-shaped cross section and include a front side plate and a lateral side plate in strip shape, the front side plate is parallel to or overlapped with the front side of the upper frame, and the lateral side plate is parallel to or overlapped with a lateral portion of the upper frame, and an upper end of the lateral side plate is provided with a notch extending horizontally, an upper end of the front side plate is provided with a fold line extending horizontally, and the fold line is set to be aligned with the notch so that the flanges are formed by bent portions, formed by rearwards bending upper ends of the upper vertical beams by 90° around the fold lines, of the upper vertical beams.

2. The frame of the clothing treating device according to claim 1, wherein the lower frame comprises a base placed horizontally, and the base is square, four corners of the base are provided with vertical beams extending vertically upwards from the base, and adjacent vertical beams on a first side and adjacent vertical beams on a second side are fixedly connected respectively via a reinforcing member to enclose a frame structure for mounting the second clothing treating drum.

3. The frame of the clothing treating device according to claim 2, wherein the lower ends of the upper vertical beams of the upper frame are fixedly connected with middle reinforcing members of the lower frame and/or upper ends of the vertical beams of the lower frame.

4. The frame of the clothing treating device according to claim 1, wherein the flanges comprise a horizontal flange horizontally bent rearwards by a top end of the front side plates of the upper vertical beams and a vertical flange vertically bent downwards by a lateral portion of the horizontal flange, the vertical flange and the lateral side plate of the upper vertical beam are correspondingly attached and are riveted to be fixed, and the end portion of the upper reinforcing member is lapped on an upper side of the horizontal flange and connected therewith via a screw.

5. The frame of the clothing treating device according to claim 4, wherein the upper reinforcing members have strip-shaped structures with L-shaped cross sections, and inner walls of the upper reinforcing members are respectively correspondingly in contact with the upper sides of the horizontal flanges and outer sides of the vertical flanges in a limiting manner.

6. A clothing treating device, comprising:

a heat pump system;

the frame according to claim 1; and a mounting platform mounted on the lower frame, and wherein the heat pump system includes a compressor and a cooling fan, the compressor is mounted on the mounting platform, and the cooling fan is fixed on the lower frame and arranged corresponding to the compressor.

7. The clothing treating device according to claim 6, wherein the lower frame comprises a lateral frame for fixing a side plate of the clothing treating device, and the cooling fan is fixed on the lateral frame.

8. The clothing treating device according to claim 7, wherein the lateral frame comprises two vertical beams vertically arranged, a middle reinforcing member is connected between the two vertical beams, and the cooling fan is fixed on the middle reinforcing member and/or one of the two vertical beams.

9. The clothing treating device according to claim 8, wherein the mounting platform is fixed between the first clothing treating drum and the second clothing treating drum in the lower frame, a middle portion of the mounting platform is protruded towards the first clothing treating drum to form a collision avoiding portion for avoiding collision with the second clothing treating drum, one side, on the mounting platform, of the collision avoiding portion is in a planar structure arrangement to form a mounting portion, the compressor is mounted on the mounting portion, and the cooling fan is fixed on the middle reinforcing member and/or one of the two vertical beams, on one side of the mounting portion, of the lower frame.

10. The clothing treating device according to claim 9, wherein the cooling fan is fixed on the lower frame via a fixing frame, the fixing frame comprises a fixing portion for mounting the cooling fan and a connecting portion for connecting and fixing to the middle reinforcing member and/or one of the two vertical beams, and the fixing portion is inclined towards the compressor so that a suction side of the cooling fan is arranged facing to the compressor.

11. The clothing treating device according to claim 10, wherein the connecting portion of the fixing frame is positioned on two sides of the fixing portion, the connecting portion at one side of the fixing portion is fixed to the middle reinforcing member, and the connecting portion at the other side of the fixing portion is fixed to one vertical beam arranged in front of the lower frame and connected with the middle reinforcing member.

12. The frame of the clothing treating device according to claim 4, wherein, a rearward extending length of the horizontal flange is greater than a horizontal width of the lateral side plate of the upper vertical beam, so that an end portion of the horizontal flange protrudes from the upper vertical beam and is provided for lapping and attaching with the upper reinforcing member.

13. A clothing treating device, comprising, a frame, and a first clothing treating drum and a second clothing treating drum mounted respectively in the frame in a vertical direction, and a heat pump system and a mounting platform, wherein, the mounting platform is fixed in the frame and positioned between the first clothing treating drum and the second clothing treating drum, and the mounting platform includes a collision avoiding portion partially protruding and a mounting portion in a planar arrangement, and the heat pump system includes a compressor fixed on the mounting portion of the mounting platform.

14. The clothing treating device according to claim 13, wherein the collision avoiding portion is of an arched structure, protruding upwards, of the mounting platform corresponding to a top of the second clothing treating drum, at least one side of the arched structure extends horizontally to form the mounting portion, and the compressor is fixed on the mounting portion of the mounting platform.

15. The clothing treating device according to claim 14, wherein the compressor is vertically fixed on the mounting platform via a fixing plate.

16. The clothing treating device according to claim 15, wherein the fixing plate comprises a plate-shaped body and a fixing support fixedly connected to the plate-shaped body, the fixing support is fixedly mounted on the mounting platform and the plate-shaped body is higher than the fixing support by a height, and the compressor is mounted on the plate-shaped body.

17. The clothing treating device according to claim 16, wherein a bottom of the compressor is provided with a bottom support, and the plate-shaped body is provided with a first connecting hole to be fixed to the bottom support of the compressor via a fastener, the fixing support comprises connecting pieces respectively connected to the plate-shaped body, each of the connecting pieces is bent towards an outer side of a top of the plate-shaped body to form a bent surface, and the bent surface is provided with a second connecting hole to be fixed to the mounting platform.

18. The clothing treating device according to claim 17, wherein the plate-shaped body has a triangular structure, each of three corners of the triangular structure is provided with one first connecting hole, three first connecting holes correspond to three bottom supports on the compressor respectively for connection and fixation via fasteners, the fixing support comprises the connecting pieces connected with three edges of the triangular structure respectively, each of the connecting pieces is bent towards an outer side of a top of the triangular structure to form the bent surface, and the bent surface is provided with the second connecting hole to be fixed to the mounting platform via the fastener.

19. The clothing treating device according to claim 18, wherein the bottom support of the compressor is higher than a bottom end of the compressor, a middle portion of the plate-shaped body is provided with a collision avoiding hole, and the bottom end of the compressor abuts against the collision avoiding hole, the collision avoiding hole supports the compressor.

* * * * *